US007191927B2

(12) United States Patent
Segura

(10) Patent No.: US 7,191,927 B2
(45) Date of Patent: Mar. 20, 2007

(54) FASTENER-DRIVING TOOL HAVING TRIGGER CONTROL MECHANISM FOR ALTERNATIVELY PERMITTING BUMP FIRING AND SEQUENTIAL FIRING MODES OF OPERATION

(75) Inventor: Ricardo Segura, Lake In The Hills, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/150,167

(22) Filed: Jun. 13, 2005

(65) Prior Publication Data

US 2006/0278678 A1 Dec. 14, 2006

(51) Int. Cl.
*B25C 1/04* (2006.01)

(52) U.S. Cl. ..... 227/8; 227/142

(58) Field of Classification Search ..... 227/8, 227/109, 120, 130, 142
See application file for complete search history.

(56) References Cited

U.S. PATENT DOCUMENTS 4,550,643 A 11/1985 Schwartzenberger
4,573,624 A * 3/1986 Muller et al. ..... 227/121
4,629,106 A 12/1986 Howard et al.
4,679,719 A 7/1987 Kramer
5,083,694 A 1/1992 Lemos
5,263,842 A 11/1993 Fealey
5,366,132 A 11/1994 Simonelli
5,522,532 A 6/1996 Chen
5,551,620 A 9/1996 Vallee
5,551,621 A 9/1996 Vallee
5,597,106 A 1/1997 Hamano et al.
5,605,268 A 2/1997 Hayashi et al.
5,653,369 A 8/1997 White
5,662,257 A * 9/1997 Mukoyama et al. ..... 227/8
5,669,541 A 9/1997 Ronconi
5,671,880 A 9/1997 Ronconi
5,687,897 A 11/1997 Fa et al.
5,732,870 A 3/1998 Moorman et al.
5,785,228 A 7/1998 Fa et al.
5,791,545 A 8/1998 Lin
5,896,933 A 4/1999 White
5,918,788 A 7/1999 Moorman et al.
6,116,488 A 9/2000 Lee
6,213,372 B1 4/2001 Chen
6,357,647 B1 3/2002 Ou
6,371,348 B1 4/2002 Canlas et al.
6,382,492 B1 5/2002 Moorman et al.
6,419,140 B1 7/2002 Chen
6,422,446 B1 7/2002 Liu
6,431,425 B1 8/2002 Moorman et al.
6,543,664 B2 4/2003 Wolfberg
6,581,814 B1 6/2003 Hsu (Continued)

*Primary Examiner*—John Sipos
*Assistant Examiner*—Michelle Lopez
(74) *Attorney, Agent, or Firm*—Schwartz & Weinrieb

(57) ABSTRACT

A fastener-driving tool has a trigger control mechanism that comprises a vertically oriented selectable mode pushrod that is adapted to be rotated to either one of two predetermined positions or states. When the vertically oriented selectable mode pushrod is disposed at a first one of its angular positions or states, the fastener-driving tool is permitted to operate in accordance with a sequential firing mode of operation, whereas when the vertically oriented selectable mode pushrod is disposed at a second one of its angular positions or states, the fastener-driving tool is permitted to operate in accordance with a bump firing mode of operation.

15 Claims, 18 Drawing Sheets

U.S. PATENT DOCUMENTS 6,588,642 B1 7/2003 Wang et al.
6,604,664 B2 8/2003 Robinson
6,659,324 B1 * 12/2003 Liu ..... 227/8
6,662,989 B1 12/2003 Chang et al.
6,675,999 B2 1/2004 Mukoyama et al.
6,722,547 B1 4/2004 Wang et al.
6,886,729 B1 * 5/2005 Lee ..... 227/8
6,929,165 B1 * 8/2005 Chen et al. ..... 227/8

* cited by examiner

FASTENER-DRIVING TOOL HAVING TRIGGER CONTROL MECHANISM FOR ALTERNATIVELY PERMITTING BUMP FIRING AND SEQUENTIAL FIRING MODES OF OPERATION

FIELD OF THE INVENTION

The present invention relates generally to powered, fastener-driving tools, wherein the tools may be electrically powered, pneumatically powered, combustion powered, or powder activated, and more particularly to a new and improved fastener-driving tool having a trigger control mechanism that comprises a vertically oriented selectable mode pushrod that is adapted to be rotated to either one of two predetermined positions or states so as to permit the fastener-driving tool to be alternatively operated in accordance with bump firing or sequential firing modes of operation.

BACKGROUND OF THE INVENTION

Powered, fastener-driving tools, of the type used to drive various fasteners, such as, for example, staples, nails, and the like, typically comprise a housing, a power source, a supply of fasteners, a trigger mechanism for initiating the firing of the tool, and a workpiece-contacting element. The workpiece-contacting element is adapted to engage or contact a workpiece, and is operatively connected to the trigger mechanism, such that when the workpiece-contacting element is in fact disposed in contact with the workpiece, and depressed or moved inwardly a predetermined amount with respect to the tool, as a result of the tool being pressed against or moved toward the workpiece a predetermined amount, the trigger mechanism will in fact be enabled so as to initiate firing of the fastener-driving tool. As is well-known in the art, powered, fastener-driving tools normally have two kinds or types of operational modes, and the tool is accordingly provided with some mechanism, such as, for example, a lever, a latch, a switch, or the like, for enabling the operator to optionally select the one of the two types or kinds of operational modes that the operator desires to use in accordance with a particularly apt mode of installing the fasteners.

More particularly, in accordance with a first one of the two types or kinds of modes of operating the powered, fastener-driving tool, known in the industry and art as the sequential or single-shot mode of operation, the depression or actuation of the trigger mechanism will not in fact initiate the firing of the tool and the driving of a fastener into the workpiece unless the workpiece-contacting element is initially depressed against the workpiece. Considered from a different point of view or perspective, in order to operate the powered, fastener-driving tool in accordance with the sequential or single-shot mode of operation, the workpiece contacting element must first be depressed against the workpiece followed by the depression or actuation of the trigger mechanism. Still further, once the particular fastener has in fact been driven into the workpiece, further or repeated depression or actuation of the trigger mechanism will not result in the subsequent driving of additional fasteners into the workpiece unless, and until, the workpiece contacting element is permitted to be effectively reset to its original position and once again disposed in contact with, and pressed against, the workpiece prior to the depression or actuation of the trigger mechanism each time the tool is to be fired so as to drive a fastener into the workpiece.

Alternatively, in accordance with a second one of the two types or kinds of modes of operating the powered, fastener-driving tool, known in the industry and art as the bump-firing mode of operation, the operator initially maintains the trigger mechanism at its depressed position, and subsequently, each time the workpiece contacting element is disposed in contact with, and pressed against, the workpiece, the tool will fire, thereby driving a fastener into the workpiece.

Continuing further, trigger assemblies are known wherein mechanisms are provided upon, or incorporated within, the trigger assemblies of the fastener-driving tools for permitting the operator to optionally select the particular one of the two types or kinds of modes of operating the powered, fastener-driving tool that the operator desires to implement in order to drive fasteners into the workpiece in a predetermined manner so as to achieve predetermined fastening procedures. One such trigger assembly is disclosed, for example, within U.S. Pat. No. 6,543,664 which issued to Wolfberg on Apr. 8, 2003. In accordance with the disclosed control system of Wolfberg, and with reference being made to FIG. 1, which substantially corresponds to FIG. 3 of the noted patent to Wolfberg, the trigger assembly is disclosed at 16 and is seen to comprise a trigger 18 which includes a pair of spaced apart side walls 20 between which there is interposed a finger contact portion 22. The side walls 20 and the finger contact portion 22 effectively define an inner cavity 30 that is open at the upper end portion 32 thereof, and an actuation lever 34 is disposed within the inner cavity 30. The actuation lever 34 is pivotally mounted within the inner cavity 30 by means of an end portion 38 thereof, which comprises an eyelet or throughbore 40 within which there is disposed a pivot pin 42, and the actuation lever 34 also comprises a free distal end portion 36. An upper corner portion of each one of the side walls 20 is provided with an eyelet or throughbore 26 within which a pivot pin 28 is disposed, and in this manner, the entire trigger assembly 16 is pivotally mounted upon the tool housing 12.

It is further seen that the pair of side walls 20 are provided with a pair of notches 46,48 within which the pivotal end portion 38 of the actuation lever 34 can be selectively disposed such that the operator can operationally choose which mode of operation the fastener-driving tool will perform, that is, either the sequential firing mode of operation or the bump firing mode of operation, and it is seen still further that the fastener-driving tool also comprises a workpiece contacting element 44. As a result of the pivotal end portion 38 of the actuation lever 34 being disposed within either one of the two positions determined by means of the pair of notches 46,48, the free distal end portion 36 of the actuation lever 34 may be disposed relatively closer to, or farther from, a trigger end portion 60 of the workpiece contacting element 44. More particularly, when the actuation lever 34 is disposed relatively further away from the trigger end portion 60 of the workpiece contacting element 44, the fastener-driving tool will be disposed in its sequential firing mode of operation, whereas when the actuation lever 34 is disposed relatively closer to the trigger end portion 60 of the workpiece contacting element 44, the fastener-driving tool will be disposed in its bump-firing mode of operation. It is seen still further that the fastener-driving tool further comprises a control valve 52 which initiates firing of the fastener-driving tool, whereby a fastener is driven outwardly from the fastener-driving tool and into the workpiece, and that a coiled spring 54 circumscribes the control valve 52 so as to be interposed between the tool housing 12 and an upper surface portion 56 of the actuation lever 34. In this manner, the actuation lever 34 is effectively biased toward the finger contact portion 22 of the trigger 18 such that the pivot pin 42 of the pivotal end portion 38 of the actuation lever 34 is assuredly seated within one of the notches 46,48. It is further appreciated that the workpiece contacting element 44 comprises a plurality of linkage members 62 which effectively integrally interconnect the actual workpiece contacting member 64 with the trigger end portion 60 thereof.

In order to appreciate the achievement, for example, of the sequential firing of the fastener-driving tool, reference is made to FIGS. 1 and 2 of the drawings, which substantially correspond to FIGS. 3 and 4 of the aforenoted Wolfberg patent. More particularly, it is to be noted that in order to fire the fastener-driving tool, and thereby drive a fastener out from the fastener-driving tool and into a workpiece, the free distal end portion 36 of the actuation lever 34 must be disposed within the vicinity of the trigger end portion 60 of the workpiece contacting element 44 such that the actuation lever 34 can in fact be moved upwardly toward the control valve 52, by means of the trigger end portion 60 of the workpiece contacting element 44, when the workpiece contacting element 44 is depressed into contact with the workpiece, so as to be ready to be subsequently moved upwardly into contact with the control valve 52 by means of the finger contact portion 22 of the trigger 18 when the finger contact portion 22 of the trigger 18 is in fact depressed or moved upwardly. Accordingly, when in fact a sequential firing mode of operation of the fastener-driving tool is to be performed, the operator will dispose the workpiece contacting member 64 of the workpiece contacting element 44 into contact with the workpiece, and subsequently, the operator will effectively move the fastener-driving tool downwardly, or toward the workpiece, causing the workpiece contacting element 44 to effectively move upwardly relative to the tool housing 12. As a result of such relative upward movement of the workpiece contacting element 44, the trigger end portion 60 of the workpiece contacting element 44 will engage the free distal end portion 36 of the actuation lever 34 so as to move the actuation lever 34 upwardly toward the control valve 52.

Subsequently, when the finger contact portion 22 of the trigger 18 is depressed or moved upwardly with respect to the tool housing 12, the entire trigger assembly 16 will be pivotally moved around the pivot pin 28 such that the actuation lever 34 can now in fact contact and actuate the control valve 52 whereby firing of the fastener-driving tool, as a result of which a fastener is discharged outwardly from the fastener-driving tool and into the workpiece, occurs. It is to be additionally noted, however, that as a result of the aforenoted pivotal movement of the entire trigger assembly 16 around the pivot pin 28 in accordance with the depression or upward movement of the finger contact portion 22 of the trigger 18 relative to the tool housing 12, the free distal end portion 36 of the actuation lever 34 will also move slightly toward the right, as viewed in FIGS. 1 and 2, relative to the vertically oriented linear path of movement of the trigger end portion 60 of the workpiece contacting element 44, as can be appreciated from a comparison of the relative disposition of the free distal end portion 36 of the actuation lever 34, during both the non-actuated or non-depressed, and the actuated or depressed, states of the finger contact portion 22 of the trigger 18 as respectively illustrated within FIGS. 1 and 2.

Accordingly, if the operator maintains the finger contact portion 22 of the trigger 18 at its depressed or upwardly moved, pivotal position relative to the tool housing 12, then when the operator removes the fastener-driving tool from its contact or depressed state with respect to the workpiece, in order to, for example, move the fastener-driving tool to a new or other location, relative to the workpiece, at which another fastener is to be driven into the workpiece, the workpiece contacting element 44 will be moved downwardly, under the biasing influence of its spring-biasing means, not illustrated, such that the trigger end portion 60 of the workpiece contacting element 44 will effectively be released or disengaged from the free distal end portion 36 of the actuation lever 34. Therefore, the actuation lever 34 will, in turn, move downwardly away from the control valve 52, under the biasing influence of the coil spring 54, so as to attain the position illustrated within FIG. 2 wherein it is noted that the free distal end portion 36 of the actuation lever 34 is in fact removed from the vertically oriented linear path of movement of the trigger end portion 60 of the workpiece contacting element 44. Accordingly, if the operator then depresses the workpiece contacting element 44 into contact with the workpiece at the new location at which the next fastener is to be driven into the workpiece, the relative upward movement of the workpiece contacting element 44 will not result in the trigger end portion 60 of the workpiece contacting element 44 engaging the free distal end portion 36 of the actuation lever 34, but to the contrary, will effectively bypass the same, whereby the actuation lever 34 will not be capable of actuating the control valve 52 so as to initiate a new firing cycle within the fastener-driving tool.

It is to be additionally appreciated that this mode of operation, or failure of operation, will also occur if, subsequent to the successful firing of the fastener-driving tool, the finger contact portion 22 of the trigger 18 is in fact released back to its non-depressed state or position as illustrated within FIG. 1, the workpiece contacting element 44 is released from its depressed state or position with respect to the workpiece whereby the workpiece contacting element 44 will effectively move vertically downwardly, and prior to the disposition of the workpiece contacting element 44 in a depressed engaged state with respect to a new site of the workpiece at which a new fastener is to be driven into the workpiece, the finger contact portion 22 of the trigger 18 is again depressed or moved upwardly with respect to the tool housing 12. In other words, in accordance with the sequential firing mode of operation, the workpiece contacting element 44 must always be moved into depressed contact engagement with a portion of the workpiece prior to the depresssion or upward movement of the finger contact portion 22 of the trigger 18 with respect to the tool housing 12.

Alternatively, as can best be appreciated from FIGS. 3 and 4, which substantially correspond to FIGS. 5 and 6 of the aforenoted Wolfberg patent, when the fastener-driving tool is desired to be operated in accordance with the bump-firing mode of operation, it is noted that the actuation lever 34 is initially moved toward the left, as viewed within FIGS. 3 and 4, such that the pivotal end portion 38 of the actuation lever 34 is now disposed within the notch 46 whereby the free distal end portion 36 of the actuation lever 34 is disposed closer to the trigger end portion 60 of the workpiece contacting element 44. This movement of the actuation lever 34 may be achieved by inserting a pointed object, such as, for example, a nail, or the like, into one end of the pivot pin 42 of the pivotal end portion 38 of the actuation lever 34, the pivot pin 42 comprising a hollow tubular structure or having recessed means formed within an end portion thereof for accommodating the nail or the like. As illustrated within FIG. 5, all components are disposed at their normal static positions, that is, the workpiece contacting element 44 has not yet been depressed against the workpiece so as not to as yet have been moved upwardly with respect to the tool housing 12, and the finger contact portion 22 of the trigger 18 has likewise not as yet been depressed or moved upwardly.

Accordingly, with the component parts disposed at their relative positions illustrated within FIG. 3, if the workpiece contacting element 44 is initially depressed into contact with a workpiece and is accordingly moved upwardly with respect to the tool housing 12, and if the finger contact portion 22 of the trigger 18 is subsequently depressed or moved upwardly with respect to the tool housing 12, then the firing mode of operation is substantially the same as that previously described in connection with the sequential firing mode of operation. However, it is to be noted that once a fastener-driving tool firing and fastener driving cycle has been completed, and another fastener-driving tool firing and fastener driving cycle is to be implemented so as to discharge another fastener out from the fastener-driving tool and drive the same into the workpiece, if the finger contact portion 22 of the trigger 18 is maintained at its depressed or upward position, as illustrated within FIG. 4, and if the workpiece contacting element 44 has been removed from its depressed contact engagement state with respect to the workpiece such that the workpiece contacting element 44 has been moved downwardly relative to the tool housing 12 under the influence of its spring biasing means, not shown, as is also illustrated within FIG. 4, the free distal end portion 36 of the actuation lever 34 will still remain disposed within the vertically oriented linear path of movement of the trigger end portion 60 of the workpiece contacting element 44 due to the previously noted relative leftward disposition of the actuation lever 34 as a result of the location of the pivotal end portion 38 of the actuation lever 34 within the notch 46. Accordingly, unlike the sequential firing mode of operation, when the workpiece contacting element 44 is again disposed in a depressed state against the workpiece, the trigger end portion 60 of the workpiece contacting element 44 can once again move the actuation lever 34 into engagement with the control valve 52 so as to in fact initiate a new firing mode or cycle within the fastener-driving tool. Therefore, relatively rapid firing of the fastener-driving tool in accordance with the bump-firing mode of operation can be achieved each time the workpiece contacting element is disposed in depressed contact against a workpiece.

While it can be appreciated that the aforenoted system of Wolfberg can successfully enable the fastener-driving tool to achieve both sequential and bump-firing modes of operation by altering the disposition of the actuation lever 34 with respect to the trigger end portion 60 of the workpiece contacting element 44, it has been noted that sometimes it is difficult to manually manipulate the pivot pin 42 so as to effectively move the pivotal end portion 38 of the actuation lever 34 from one of the notches 46,48 to the other one of the notches 46,48 in order to effectively change-over or alter the firing mode of operation of the fastener-driving tool. As has been noted, in order to achieve such an alteration in the firing mode of operation of the fastener-driving tool, a nail or similarly sharp-pointed object must be inserted into at least one of the hollow or recessed ends of the pivot pin 42, and in addition, the pivotal end portion 38 of the actuation lever 34 must be disengaged from one of the notches 46,48, against the biasing force of coiled spring 54, so as to permit the pivot pin 42 to then be inserted into the other one of the notches 46,48.

A need therefore exists in the art for a new and improved fastener-driving tool which can be provided with a trigger control mechanism that can be easily actuated or manipulated to either one of two predetermined positions or states so as to permit the fastener-driving tool to be alternatively operated in accordance with bump firing or sequential firing modes of operation.

SUMMARY OF THE INVENTION

The foregoing and other objectives are achieved in accordance with the teachings and principles of the present invention through the provision of a new and improved trigger control mechanism, for use within a fastener-driving tool, wherein the new and improved trigger control mechanism comprises a trigger housing, a guide bushing having a longitudinal axis, and a selectable mode pushrod which is operatively connected to a workpiece contacting element and which is coaxially disposed within the guide bushing so as to be longitudinally movable within the guide bushing along the longitudinal axis thereof, as well as being rotatable around the longitudinal axis thereof between two operative positions angularly located 180° apart from each other. The two operative positions located 180° apart from each other respectively determine the two sequential firing and bump firing modes of operation of the fastener-driving tool.

Accordingly, when the selectable mode pushrod is disposed at a first angular position, at which, for example, the sequential firing mode of operation of the fastener-driving tool is to be enabled, an upstanding distal end portion of the selectable mode pushrod will be disposed at a first position which will enable such upstanding distal end portion of the selectable mode pushrod to be engaged with the free distal end portion of the actuation lever of the trigger assembly when a firing cycle is to be initiated by depression or upward movement of the finger contact portion of the trigger, but which will also permit the free distal end portion of the actuation lever of the trigger assembly to effectively be disengaged from the upstanding distal end portion of the selectable mode pushrod, once a firing cycle has been completed and the selectable mode pushrod has been moved away from the free distal end portion of the actuation lever under the influence of the workpiece contacting element operatively connected to the selectable mode pushrod, as a result of the free distal end portion of the actuation lever of the trigger assembly effectively being moved out of the vertically oriented linear path of movement of the upstanding distal end portion of the selectable mode pushrod. Accordingly, subsequent firing cycles of the fastener-driving tool can only be achieved if the finger contact portion of the trigger is permitted to return to its non-depressed or downward position prior to the depressed engagement of the workpiece contacting element with another region of the workpiece whereby the up-standing distal end portion of the selectable mode pushrod can once again engage the free distal end portion of the actuation lever.

Conversely, when the selectable mode pushrod is disposed at the second angular position, at which, for example, the bump firing mode of operation of the fastener-driving tool is to be enabled, the selectable mode pushrod will have been rotated through an angular displacement of 180° whereby the upstanding distal end portion of the selectable mode pushrod will now be disposed at a second position with respect to the free distal end portion of the actuation lever of the trigger assembly which will not only enable such upstanding distal end portion of the selectable mode pushrod to likewise effectively be engaged with the free distal end portion of the actuation lever of the trigger assembly when a firing cycle is to be initiated, but in addition, the locus of the vertically oriented linear path of movement of the selectable mode pushrod will have effectively been moved inwardly a predetermined amount toward the proximal or pivotal end portion of the actuation lever. Accordingly, unlike the disposition of the free distal end portion of the actuation lever of the trigger assembly with respect to the vertically oriented linear path of movement of the upstanding distal end portion of the selectable mode pushrod when the selectable mode pushrod was disposed at its first position for enabling sequential firing of the fastener-driving tool, the free distal end portion of the actuation lever of the trigger assembly will effectively remain disposed along the vertically oriented linear path of movement of the upstanding distal end portion of the selectable mode pushrod so as to enable the upstanding distal end portion of the selectable mode pushrod to again be engaged with the free distal end portion of the actuation lever of the trigger assembly even when a firing cycle has been completed and the finger contact portion of the trigger is maintained at its depressed or upwardly moved position. In this manner, additional firing cycles are able to be completed in accordance with the bump firing mode of operation of the fastener-driving tool.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 5:
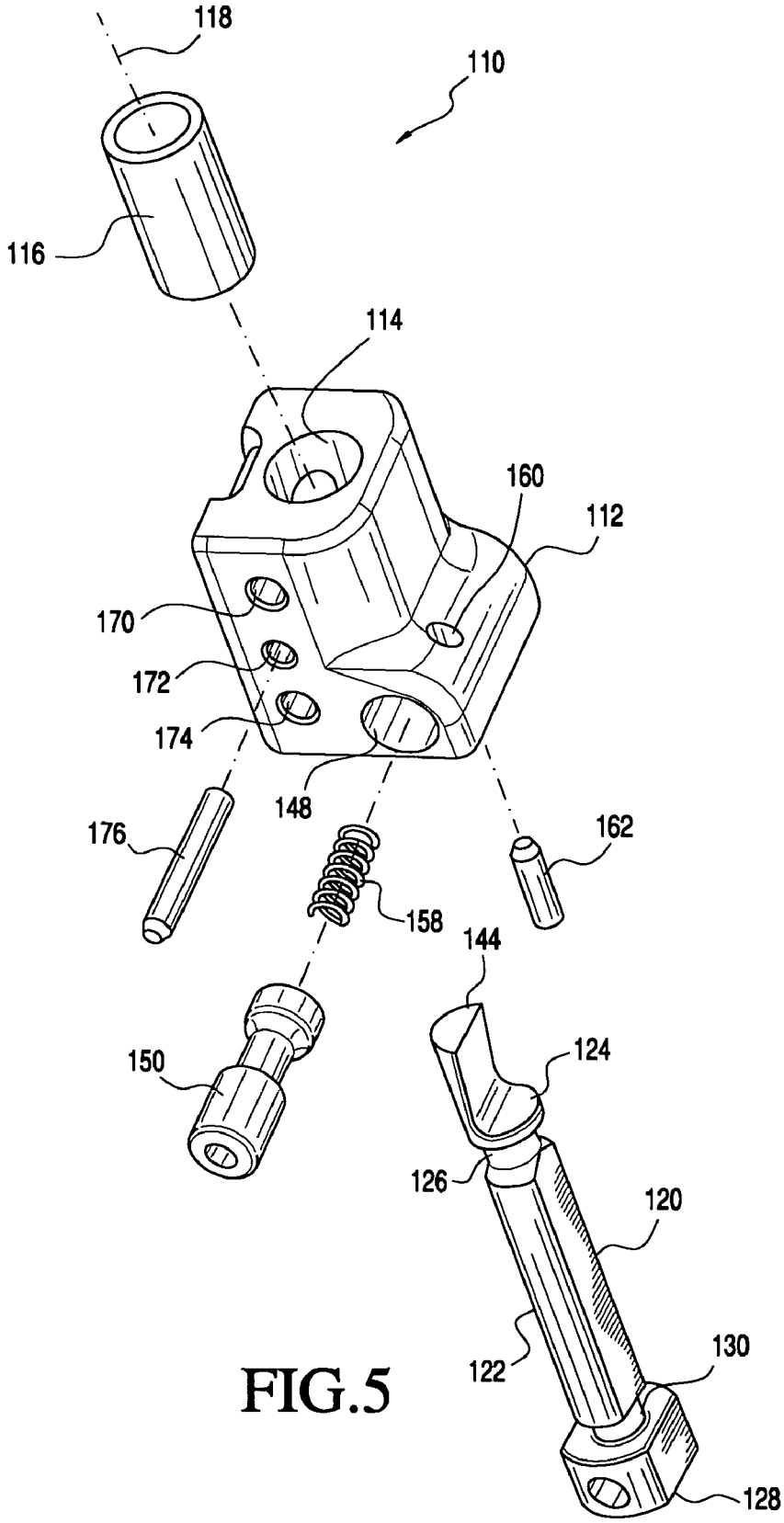
FIG. 5 is an exploded view illustrating the new and improved trigger control mechanism constructed in accordance with the principles and teachings of the present invention and showing the cooperative component parts thereof.
Figure 6:
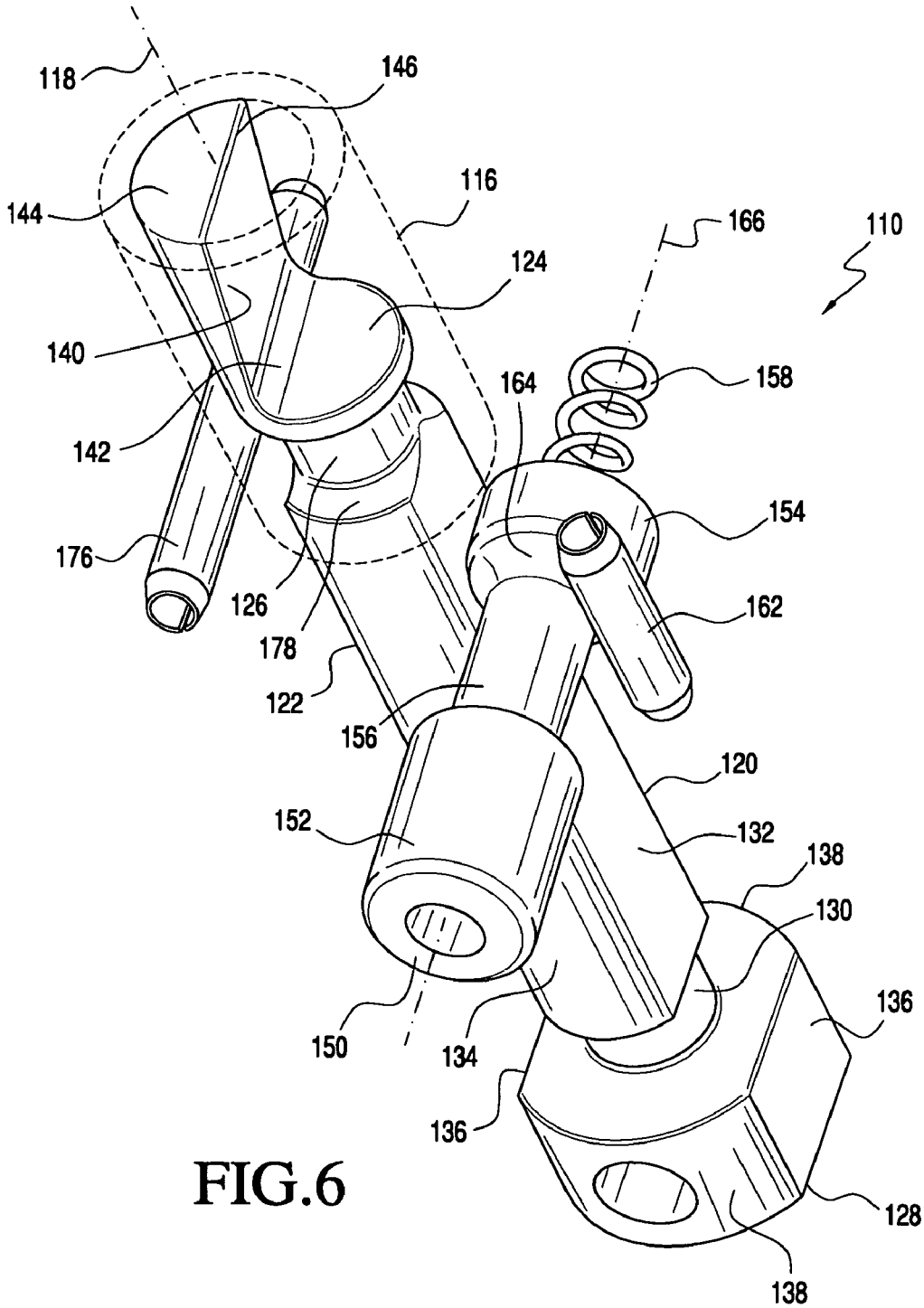
FIG. 6 is a perspective view of the new and improved trigger control mechanism of the present invention, as has been illustrated within FIG. 5, when the various component parts of the trigger control mechanism are assembled together and are disposed in a first one of their static positions or states so as to enable the fastener-driving tool to achieve, for example, its sequential firing mode operation.
Figure 7:
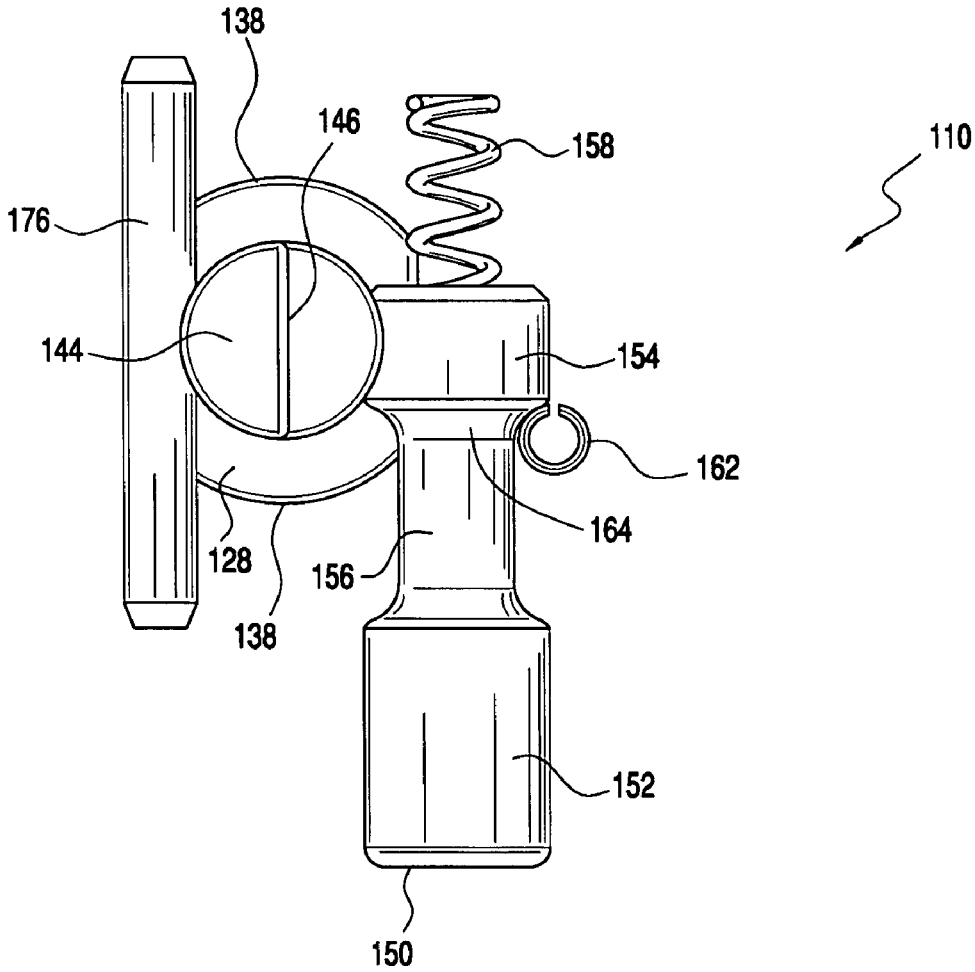
FIG. 7 is a top plan view of the assembled trigger control mechanism as illustrated within FIG. 6.

Referring now to the drawings, and more particularly to FIGS. 5–7 thereof, the new and improved trigger control mechanism, constructed in accordance with the principles and teachings of the present invention and showing the cooperative component parts thereof, is disclosed and is generally indicated by the reference character 110. It is to be initially noted that, while it is understood that the fastener-driving tool may be positioned at various orientations when the same is being used to drive a fastener into a particular workpiece, for the purposes of this description, the various components of the trigger control mechanism 110 will be noted as being vertically oriented in view of the fact that the various components of the trigger control mechanism 110 are actually illustrated as being vertically oriented. More particularly then, the new and improved trigger control mechanism 110 is seen to comprise a trigger housing 112 which has a vertically oriented throughbore 114 defined therein, and a guide bushing 116 is adapted to be fixedly mounted within the vertically oriented throughbore 114. The vertically oriented throughbore 114 and the vertically oriented guide bushing 116 define a longitudinal axis 118, and a vertically oriented selectable mode pushrod 120 is adapted to be movably disposed within the guide bushing 116 so as to be movable along the longitudinal axis 118 thereof.

The vertically oriented selectable mode pushrod 120 is seen to comprise a vertically oriented shaft member 122, a head portion 124 which is integrally connected to the upper end portion of the shaft member 122 by means of an upper neck portion 126, and a base portion 128 which is integrally connected to the lower end portion of the shaft member 122 by means of a lower neck portion 130 at which location the vertically oriented selectable mode pushrod 120 is operatively connected to the workpiece contacting element, not shown, of the fastener-driving tool. The vertically oriented shaft member 122 is seen to have a substantially elliptical cross-sectional configuration comprising a pair of oppositely disposed flat side surfaces 132, only one of which is visible, and a pair of oppositely disposed arcuate end surfaces 134, only one of which is likewise visible. It is also noted, as will be discussed more fully apparent hereinafter, that the distance or diametrical extent defined between the pair of oppositely disposed flat side surfaces 132 of the shaft member 122 is therefore less than the distance of diametrical extent defined between the pair of oppositely disposed arcuate end surfaces 134 of the shaft member 122. It is further noted that the base portion 128 of the vertically oriented selectable mode pushrod 120 likewise has a substantially elliptical cross-sectional configuration comprising a pair of oppositely disposed flat side surfaces 136,136, and a pair of oppositely disposed arcuate end surfaces 138,138.

Still yet further, it is also noted that the diametrical extent of the base portion 128 of the vertically oriented selectable mode pushrod 120 is substantially larger than that of the shaft member 122 of the vertically oriented selectable mode pushrod 120, and as a result of such structural features characteristic of the base portion 128 of the vertically oriented selectable mode pushrod 120, the base portion 128 of the vertically oriented selectable mode pushrod 120 will serve as a manipulable handle by means of which an operator can rotate the vertically oriented selectable mode pushrod 120 around the vertically oriented axis 118 so as to effectively switch the disposition of the vertically oriented selectable mode pushrod 120, with respect to the actuation lever of the trigger assembly of the fastener-driving tool, whereby the vertically oriented selectable mode pushrod 120 can operatively cooperate with the trigger assembly of the fastener-driving tool so as to selectively enable the fastener-driving tool to operate within one of the two sequential firing and bump firing modes of operation as will be more fully discussed hereinafter. In connection with the two sequential firing and bump firing modes of operation, one of the oppositely disposed flat side surfaces 136,136 preferably has visual indicia noted thereon, such as, for example, SA, so as to visually indicate to the operator that the vertically oriented selectable mode pushrod 120 has been rotated to its predetermined position at which the sequential actuation firing mode of the fastener-driving tool will be implemented, while the other one of the oppositely disposed flat side surfaces 136,136 preferably has visual indicia noted thereon, such as, for example, BA, so as to visually indicate to the operator that the vertically oriented selectable mode pushrod 120 has been rotated to its predetermined position at which the bump firing actuation mode of the fastener-driving tool will be implemented. Alternatively, in lieu of the SA and BA indicia, the oppositely disposed flat side surfaces 136,136 can be suitably color-coded.

Continuing further, it is additionally seen that the head portion 124 of the vertically oriented selectable mode pushrod 120 has an upstanding projection 140 integrally formed thereon wherein it is seen that the upstanding projection has a substantially semi-cylindrical cross-sectional configuration. More particularly, it is seen that the upstanding projection 140 is integrally connected to, for example, one peripheral edge region of the head portion 124 of the vertically oriented selectable mode pushrod 120 by means of a relatively narrow base section 142, and that the upstanding projection 140 tapers upwardly and radially inwardly toward a distal end portion 144 that has a diametrical extent which is approximately one-half the diametrical extent of the head portion 124 of the vertically oriented selectable mode push-rod 120 as determined, for example, by means of the diametrically extending edge member 146 of the upstanding distal end portion 144 of the vertically oriented selectable mode pushrod 120 which effectively intersects, and extends perpendicular to, the longitudinal axis 118.

It can therefore be appreciated, and as will be more fully discussed hereinafter, that when the vertically oriented selectable mode pushrod 120 is disposed at its position illustrated within FIGS. 6 and 10, the upstanding distal end portion 144 of the vertically oriented selectable mode push-rod 120 will be disposed upon the left side of the longitudinal axis 118, whereas when the vertically oriented selectable mode pushrod 120 is rotated 180 around its longitudinal axis 118, the upstanding distal end portion 144 of the vertically oriented selectable mode pushrod 120 will be disposed upon the right side of the longitudinal axis 118. As will be appreciated more fully herein-after, the upstanding distal end portion 144 of the vertically oriented selectable mode pushrod 120 will therefore be capable of engaging different regions or areas of the actuation lever of the trigger assembly of the fastener-driving tool, when the vertically oriented selectable mode pushrod 120 is rotatably disposed at a selected one of its two rotatable positions located 180° apart from each other, so as to enable the fastener-driving tool to in fact achieve a selected one of its sequential firing and bump firing modes of operation.

Continuing further, and with reference again being made to FIGS. 5–7, the trigger housing 112 of the new and improved trigger control mechanism 110 further includes a horizontally oriented blind bore 148 within which a pushrod lock pin 150 is movably disposed. The pushrod lock pin 150 is seen to comprise a first externally accessible end portion 152, and a second oppositely disposed end portion 154 which is adapted to be disposed internally within the horizontally oriented blind bore 148. The oppositely disposed externally accessible and internally disposed end portions 152,154 are integrally interconnected together by means of an intermediate shank portion 156, and it is seen that the diametrical extent of both the oppositely disposed externally accessible and internally disposed end portions 152,154 is substantially greater than the diametrical extent of the intermediate shank portion 156. A coil spring 158 is disposed within the horizontally oriented blind bore 148 of the trigger housing 112 so as to be interposed between the internal end wall of the horizontally oriented blind bore 148 and the internally disposed end face of the internally disposed end portion 154 of the pushrod lock pin 150 in order to thereby normally bias the pushrod lock pin 150 in an outward direction with respect to the horizontally oriented blind bore 148. In order to prevent the pushrod lock pin 150 from inadvertently and undesirably becoming dislodged from the horizontally oriented blind bore 148, a vertically oriented throughbore 160 is defined within the trigger housing 112 so as to intersect the horizontally oriented blind bore 148, and a vertically oriented retention pin 162 is fixedly disposed within the vertically oriented throughbore 160. Accordingly, as can best be appreciated from FIGS. 6 and 7, when the pushrod lock pin 150 is disposed at its normal, outwardly biased position, under the influence of the biasing force of the coil spring 158, the vertically oriented retention pin 162 will operatively engage, or be disposed within, a recessed region defined by means of a shoulder portion 164 which is formed between the internally disposed end portion 154 and the intermediate shank portion 156 of the pushrod lock pin 150 so as to in fact prevent the pushrod lock pin 150 from becoming dislodged or separated from its disposition within the horizontally oriented blind bore 148. It is to be noted further that when the pushrod lock pin 150 is disposed at its normal, outwardly biased position, under the influence of the biasing force of the coil spring 158, the large diameter internally disposed end portion 154 of the pushrod lock pin 150 will be engaged with one of the oppositely disposed flat surface portions 132 of the vertically oriented selectable mode pushrod 120, as can best be appreciated from FIG. 6, and in this manner, rotation of the vertically oriented selectable mode pushrod 120, from its position illustrated within FIG. 6, is effectively prevented so as to effectively lock in or stably establish or define the particular one of the fastener-driving tool sequential firing or bump firing modes of operation.

Figure 8:
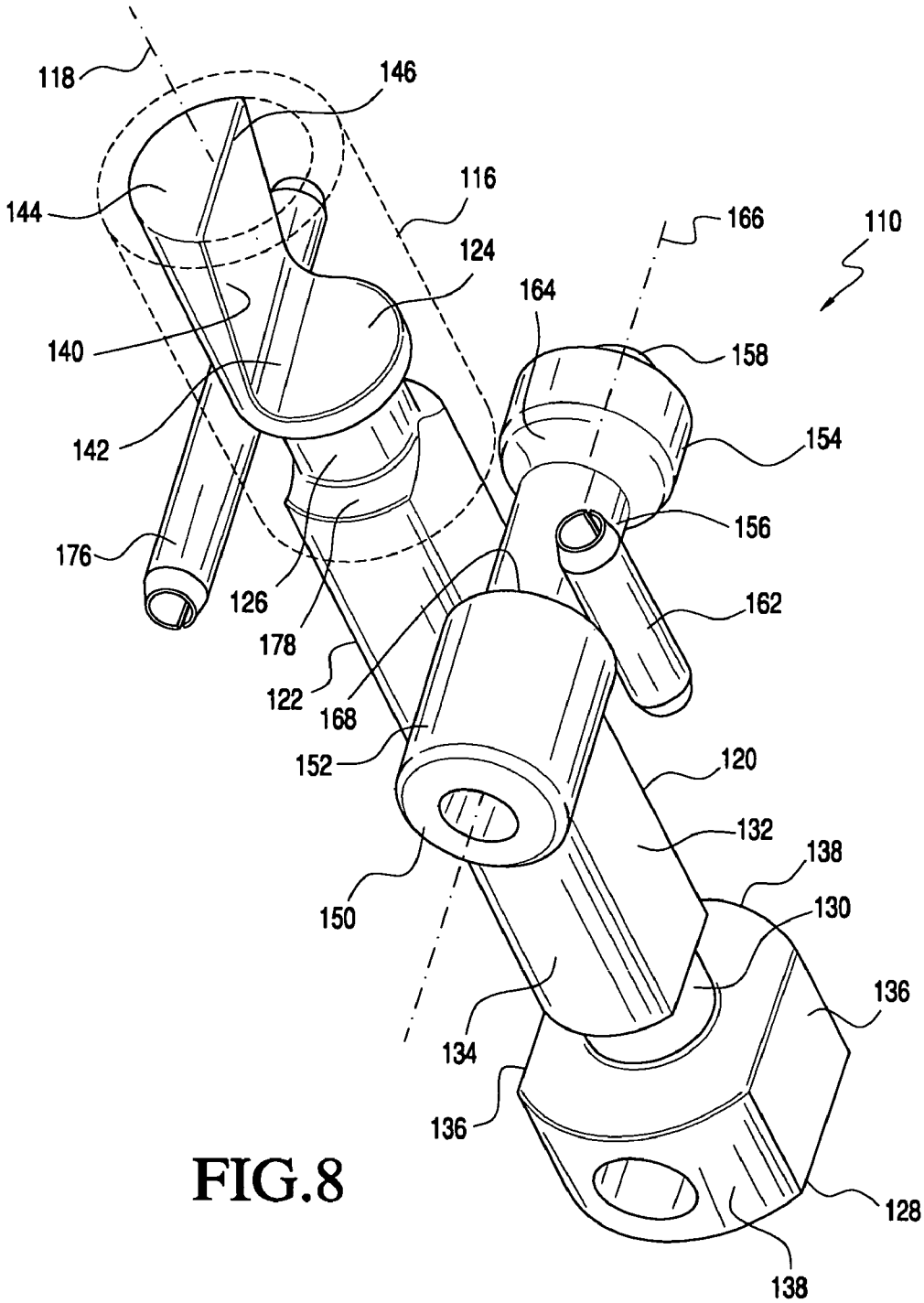
FIG. 8 is a perspective view of the assembled trigger control mechanism, similar to that illustrated within FIG. 6, showing, however, the various component parts of the trigger control mechanism when the pushrod lock pin has been depressed so as to enable the selectable mode pushrod of the trigger control mechanism to be moved from a first one of its positions or states, which enables the fastener-driving tool to achieve, for example, its sequential firing mode of operation, to a second one of its positions or states which enables the fastener-driving tool to achieve, for example, its bump-firing mode of operation.
Figure 9:
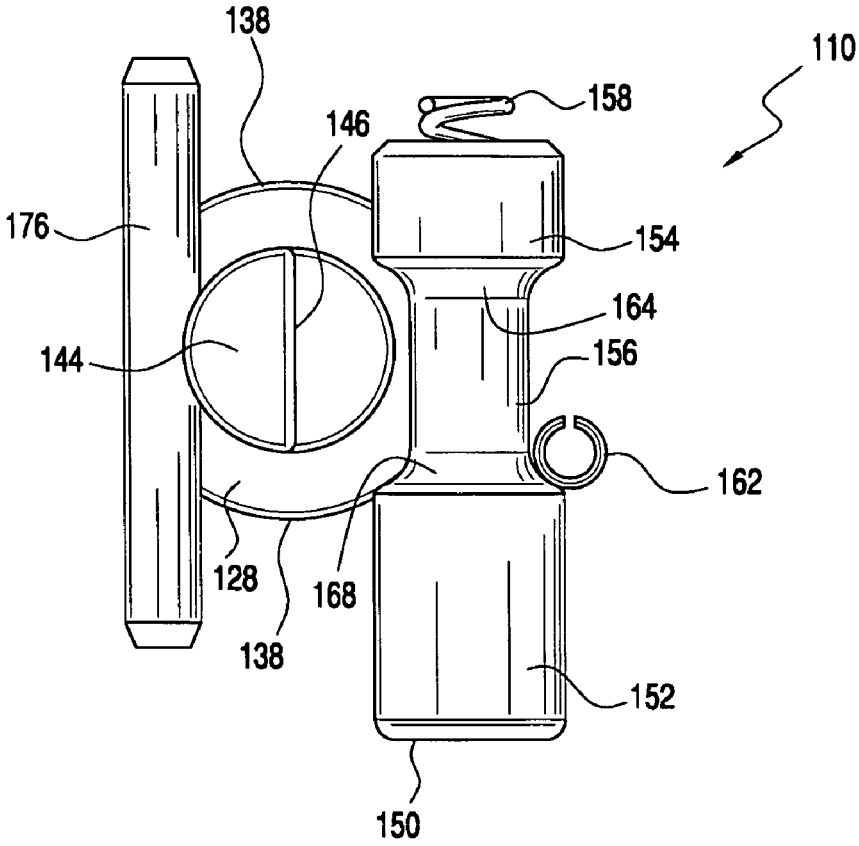
FIG. 9 is a top plan view of the assembled trigger control mechanism as illustrated within FIG. 8.

This is seen to be the case in view of the fact that the transverse or lateral disposition of the pushrod lock pin 150 is effectively fixed as a result of the engagement of the vertically oriented retention pin 162 with the recessed shoulder portion 164 of the pushrod lock pin 150, and in view of the fact that in order to permit or achieve the angular rotation of the vertically oriented selectable mode pushrod 120 around its longitudinal axis 118, the larger diametrical extent of the shaft member 122 of the vertically oriented selectable mode pushrod 120, as defined between the oppositely disposed arcuate end portions 134, must be accommodated, which is not possible while the pushrod lock pin 150 is disposed at its position or state illustrated within FIG. 6. In order to in fact accommodate the larger diametrical extent of the shaft member 122 of the vertically oriented selectable mode pushrod 120, as defined between the oppositely disposed arcuate end portions 134, so as to permit or facilitate the angular rotation of the of the vertically oriented selectable mode pushrod 120 around its longitudinal axis 118, and thereby effectively enable the fastener-driving tool to be switched between its sequential firing and bump-firing modes of operation, an operator may push the pushrod lock pin 150 inwardly along its axis 166, against the biasing force of the coil spring 158, such that the pushrod lock pin 150 will move from the position shown in FIGS. 6 and 7 to the position illustrated within FIGS. 8 and 9.

When the pushrod lock pin 150 is therefore moved inwardly along the axis 166, a recessed region defined by means of a shoulder portion 168, which is formed between the externally disposed end portion 152 and the intermediate shank portion 156 of the pushrod lock pin 150, will encounter the vertically oriented retention pin 162 which therefore stops the inward movement of the pushrod lock pin 150 and defines its inner position. As can therefore be appreciated still further from FIGS. 8 and 9, when the pushrod lock pin 150 is disposed at this position, the smaller diameter intermediate shank portion 156 will now be disposed adjacent to, and spaced from, the flat surface portion 132 of the vertically oriented selectable mode pushrod 120. Accordingly, sufficient space is now effectively defined or provided between the smaller diameter intermediate shank portion 156 and the flat surface portion 132 of the vertically oriented selectable mode pushrod 120 so as to not only permit the vertically oriented selectable mode pushrod 120 to begin rotation, but in addition, sufficient space is now effectively defined or provided between the smaller diameter intermediate shank portion 156 and the flat surface portion 132 of the vertically oriented selectable mode push-rod 120 so as to fully accommodate the larger diametrical extent of the shaft member 122 of the vertically oriented selectable mode pushrod 120, as defined between the oppositely disposed arcuate end portions 134, so as to permit the vertically oriented selectable mode pushrod 120 to in fact complete a rotational movement comprising 180° whereby the fastener-driving tool will able to be converted from one of the sequential firing and bump-firing mode of operations to the other one of the sequential firing and bump-firing mode of operations.

Figure 10:
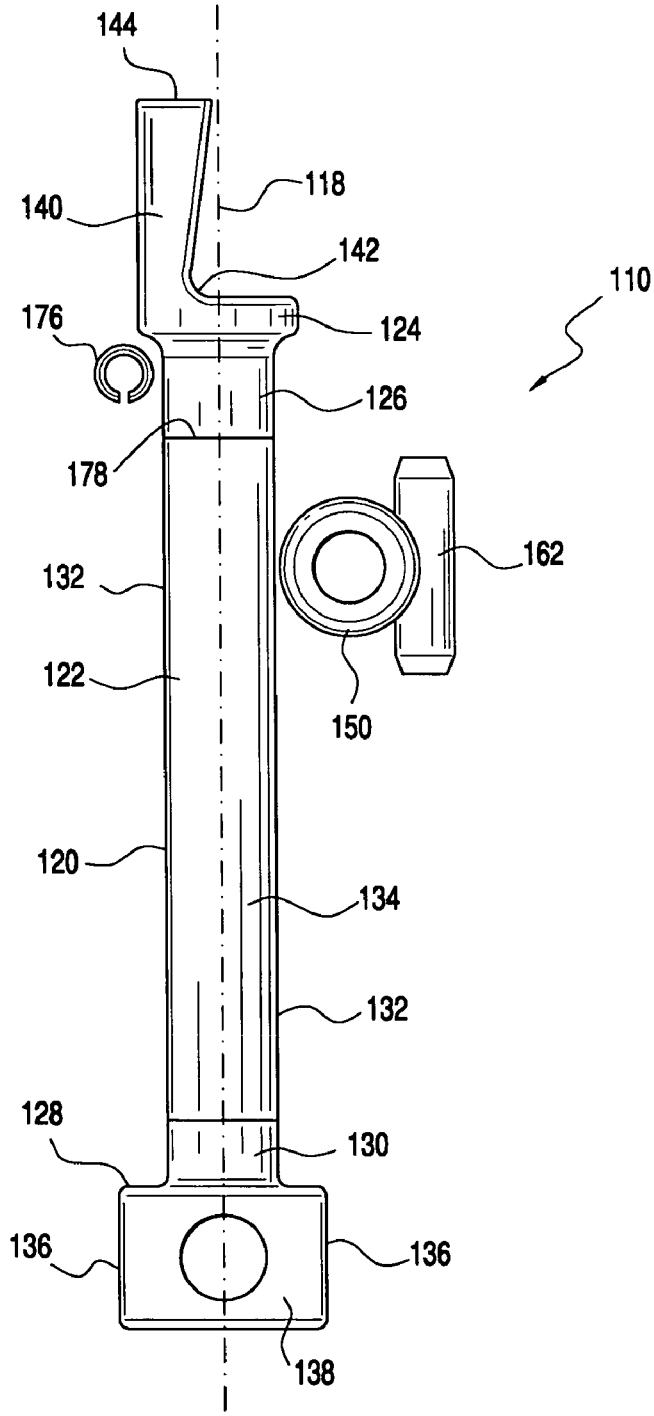
FIG. 10 is a side elevational view of the new and improved trigger control mechanism, as disclosed within FIGS. 6 and 7, wherein the various component parts of the trigger control mechanism, particularly the selectable mode pushrod, are disposed at their proper positions so as to permit the fastener-driving tool to be actuated and fired in order to achieve, for example, its sequential firing mode of operation.
Figure 11:
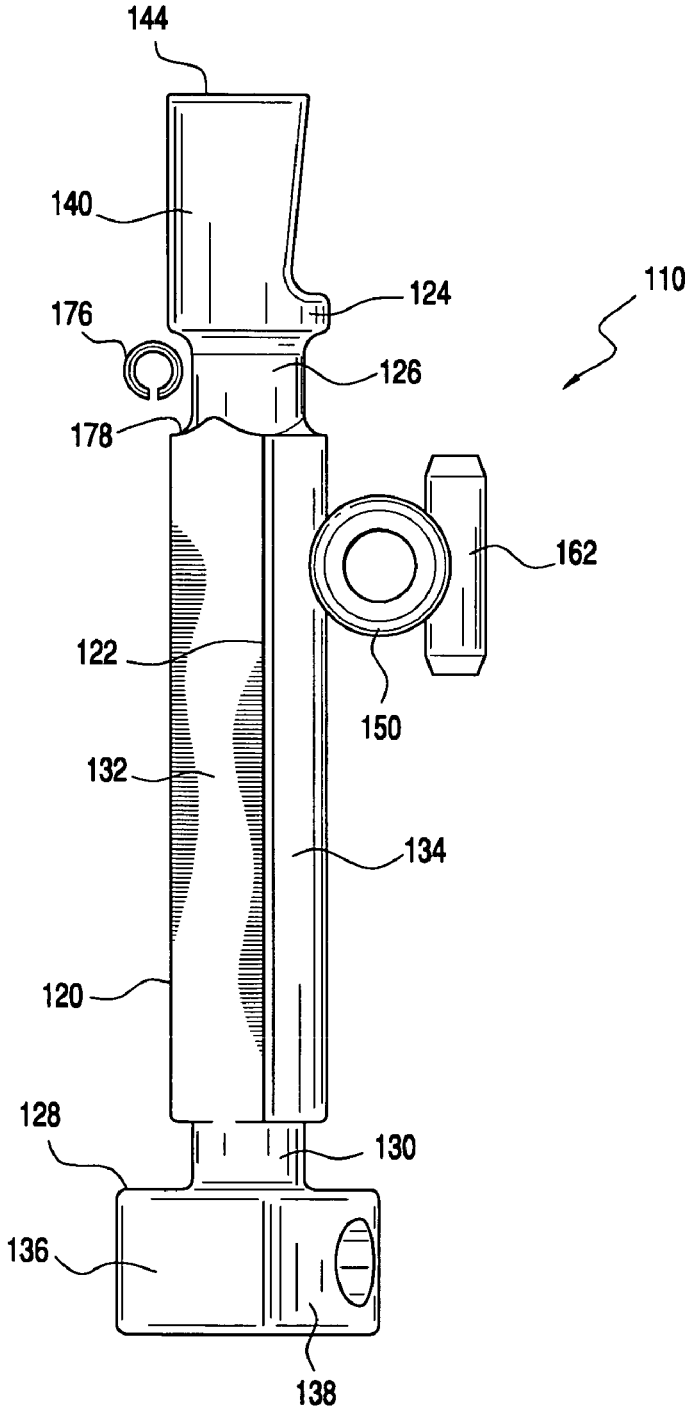
FIG. 11 is a side elevational view of the new and improved trigger control mechanism, as disclosed within FIGS. 6,7, and 10 wherein, however, the various component parts of the trigger control mechanism, particularly the selectable mode pushrod, are not disposed at their proper positions whereby the fastener-driving tool will not be able to be actuated and fired in order to achieve, for example, its sequential firing mode of operation.

With reference again being made to FIG. 5, and with additional reference to FIGS. 10 and 11, it is seen that the trigger housing 112 is also provided with a plurality of apertures or bores 170,172,174 which are arranged in a vertical array. The upper and lower apertures or bores 170, 174 are provided for accommodating suitable fasteners, not shown, for securing the trigger housing 112 within the tool housing, and the middle aperture or bore 172 is provided for accommodating a tool-enabling pin 176. Both of the aperture or bore 172 and the tool-enabling pin 176 extend through both the trigger housing 112 and the guide bushing 116, and it is further seen that the tool-enabling pin 176 is disposed at an elevational position which corresponds to the location of the upper neck portion 126 of the shaft member 122 when the vertically oriented selectable mode pushrod 120 is disposed at its lowermost position, that is, when the workpiece contacting element is not depressed against a workpiece, whereby as can best be appreciated from FIGS. 10 and 11, the tool-enabling pin 176 will be disposed immediately adjacent to, but spaced a predetermined distance from, the plane of the one of the pair of oppositely disposed flat side surfaces 132 of the shaft member 122 of the vertically oriented selectable mode pushrod 120 which is disposed opposite to, or facing, the tool-enabling pin 176.

Accordingly, it can be appreciated that when the vertically oriented selectable mode pushrod 120 is properly disposed at one of its two sequential firing or bump-firing determination modes or positions spaced 180° apart, whereby one of the pair of oppositely disposed flat side surfaces 132 of the shaft member 122 of the vertically oriented selectable mode pushrod 120 will be disposed immediately adjacent to, or substantially in contact with, the internally disposed large-diameter end portion 154 of the pushrod lock pin 150, as illustrated within FIG. 10, the vertically oriented selectable mode pushrod 120 may in fact be moved vertically upwardly within the guide bushing 116, in accordance with the depression of the work-piece contacting element against the workpiece, so as to in fact permit the actuation and firing of the fastener-driving tool in accordance with one of its sequential firing or bump-firing modes of operation. To the contrary, however, if the pushrod lock pin 150 has been depressed inwardly against the biasing force of the coil spring 158 in preparation for the switching of the fastener-driving tool firing mode of operation, between its sequential firing and bump-firing modes of operation, and if, before the vertically oriented selectable mode pushrod 120 has been fully rotated to one of its two properly disposed sequential firing or bump-firing determination modes or positions spaced 180° apart, as determined by one of the pair of oppositely disposed flat side surfaces 132 of the shaft member 122 of the vertically oriented selectable mode pushrod 120 being disposed immediately adjacent to, or substantially in contact with, the internally disposed large-diameter end portion 154 of the pushrod lock pin 150, rotation of the vertically oriented selectable mode pushrod 120 is terminated and the pushrod lock pin 150 is released, the shoulder portion 164 of the pushrod lock pin 150 will effectively engage a portion of one of the arcuate end surfaces 134 of the vertically oriented selectable mode pushrod 120.

Accordingly, the vertically oriented selectable mode pushrod 120 will be improperly disposed at an angular position which is effectively intermediate one of its proper sequential firing or bump-firing determination modes or positions, as is illustrated within FIG. 11. In addition, it is noted that shoulder portions 178, defined between each one of the large-diameter arcuate end surfaces 134 of the vertically oriented selectable mode pushrod 120 and the upper neck portion 126 of the vertically oriented selectable mode pushrod 120, project outwardly beyond the diametrical extent of the upper neck portion 126 of the vertically oriented selectable mode pushrod 120. Therefore, when the vertically oriented selectable mode pushrod 120 is elevated, in response to the depression of the workpiece contacting element against the workpiece, the one of the shoulder portions 178 which is disposed adjacent to the tool-enabling pin 176 will engage the undersurface portion of the tool-enabling pin 176 whereby further upward movement of the vertically oriented selectable mode pushrod 120 will be arrested such that the fastener-driving tool cannot in fact be actuated and fired.

It is additionally noted that for similar reasons, the angular rotation of the vertically oriented selectable mode push-rod 120 around its axis 118, in order to effectively switch the firing mode of operation of the fastener-driving tool between the sequential firing and bump-firing modes of operation, can only occur when the vertically oriented selectable mode pushrod 120 is disposed at its lowermost position, that is, when the workpiece contacting element is not depressed against a workpiece. The reason for this can be appreciated from a comparison of FIGS. 10 and 11. More particularly, if the vertically oriented selectable mode pushrod 120 is rotated while the vertically oriented selectable mode pushrod 120 is disposed at its upper position as a result of the workpiece contacting element being depressed against a workpiece, then the large diameter portion of the shaft member 122 of the vertically oriented selectable mode pushrod 120, as defined between the oppositely disposed arcuate end surfaces 134,134, will be disposed adjacent to the tool-enabling pin 176. However, one of the oppositely disposed arcuate end surfaces 134,134 will effectively interfere with the fixed disposition of the tool-enabling pin 176 whereby further rotation of the vertically oriented selectable mode pushrod 120 will be arrested or prevented.

Figure 1:
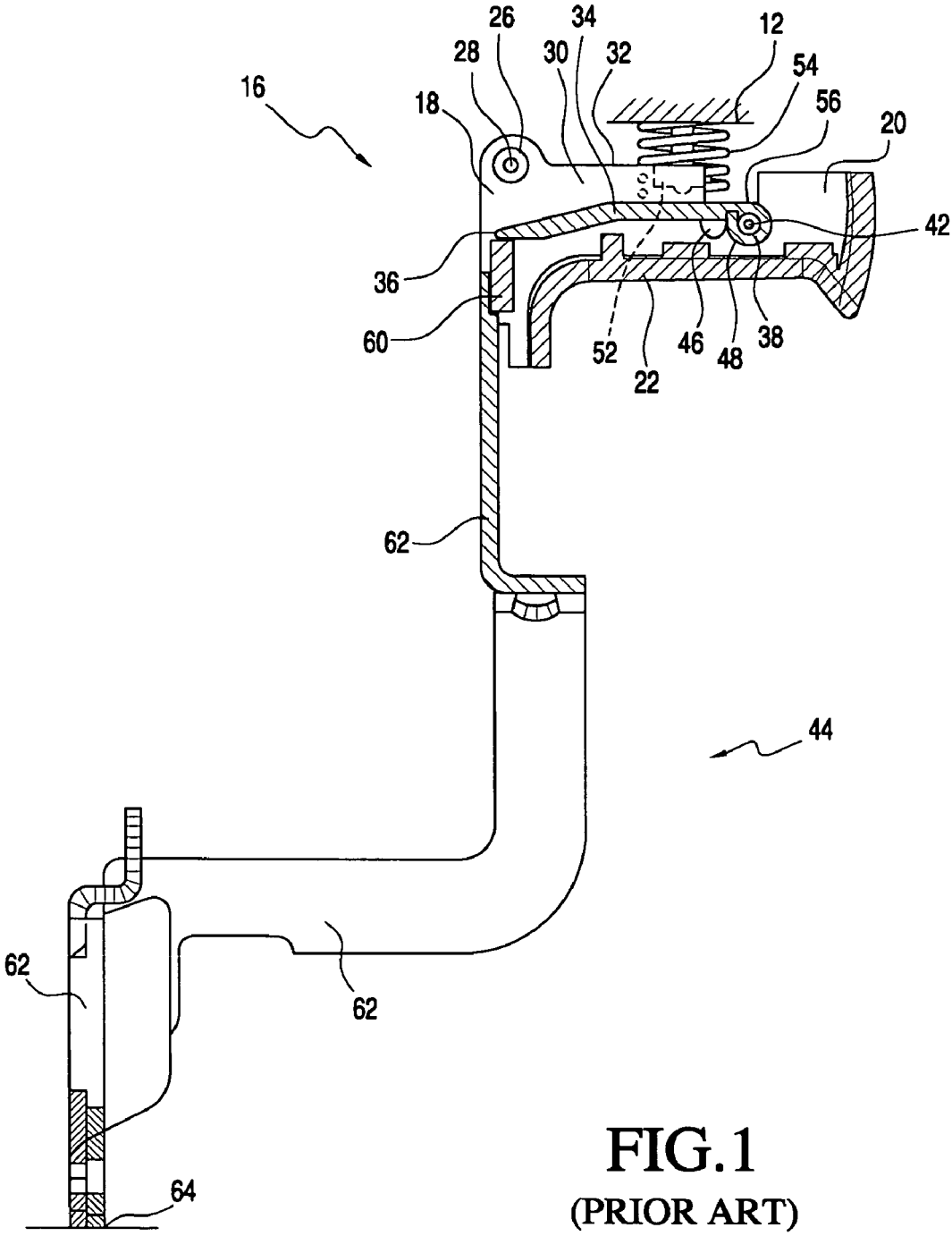
FIG.1 (PRIOR ART)
FIG. 1 is a cross-sectional view of a conventional, PRIOR ART trigger control mechanism for a fastener-driving tool wherein the actuation lever is positioned upon the trigger assembly at its sequential firing mode position, the workpiece contacting element has been depressed against the workpiece, but the finger contact portion of the trigger has not yet been depressed or moved upwardly.
Figure 2:
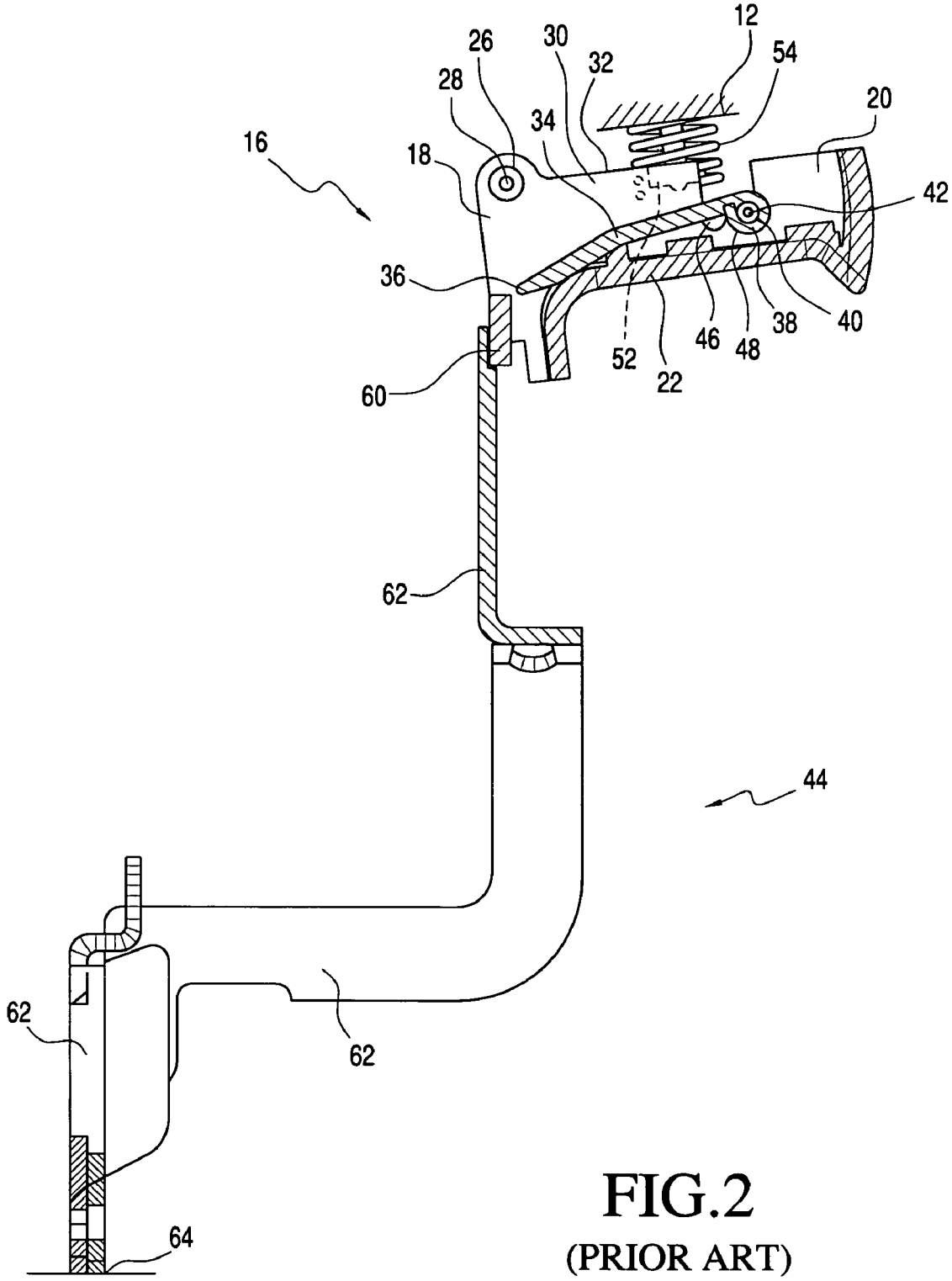
FIG.2 (PRIOR ART)
FIG. 2 is a cross-sectional view of the conventional, PRIOR ART trigger control mechanism for the fastener-driving tool, as disclosed within FIG. 1, wherein the actuation lever is positioned upon the trigger assembly at its sequential firing mode position, the workpiece contacting element has been removed from its depressed state against the workpiece, and the finger contact portion of the trigger has been depressed or moved upwardly.
Figure 3:
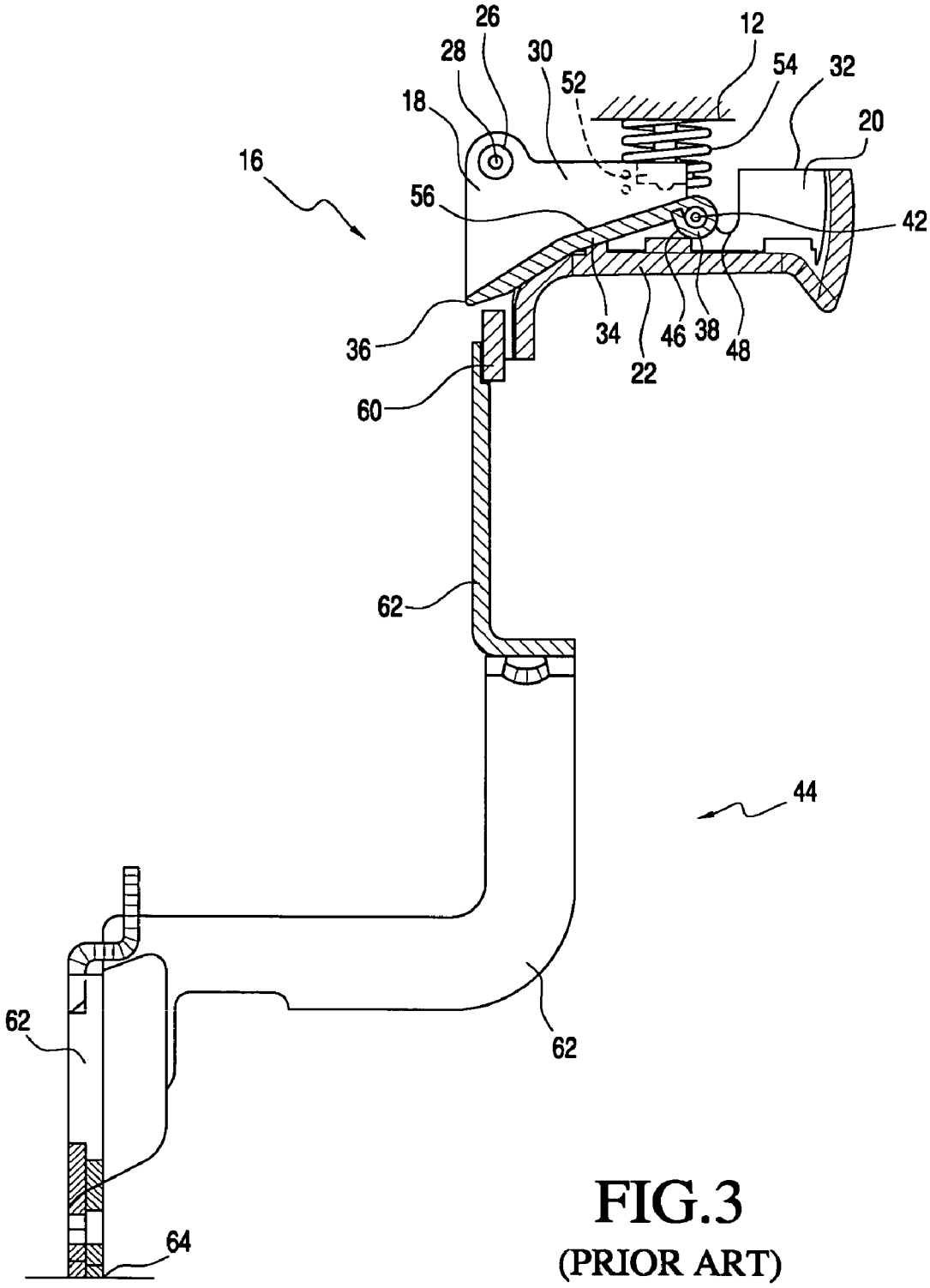
FIG.3 (PRIOR ART)
FIG. 3 is a cross-sectional view of the conventional, PRIOR ART trigger control mechanism for the fastener-driving tool, as disclosed within FIGS. 1 and 2, wherein, however, the actuation lever is positioned upon the trigger assembly at its bump firing mode position, the workpiece contacting element has not as yet been depressed against the workpiece, and the finger contact portion of the trigger has not as yet been depressed or moved upwardly.
Figure 4:
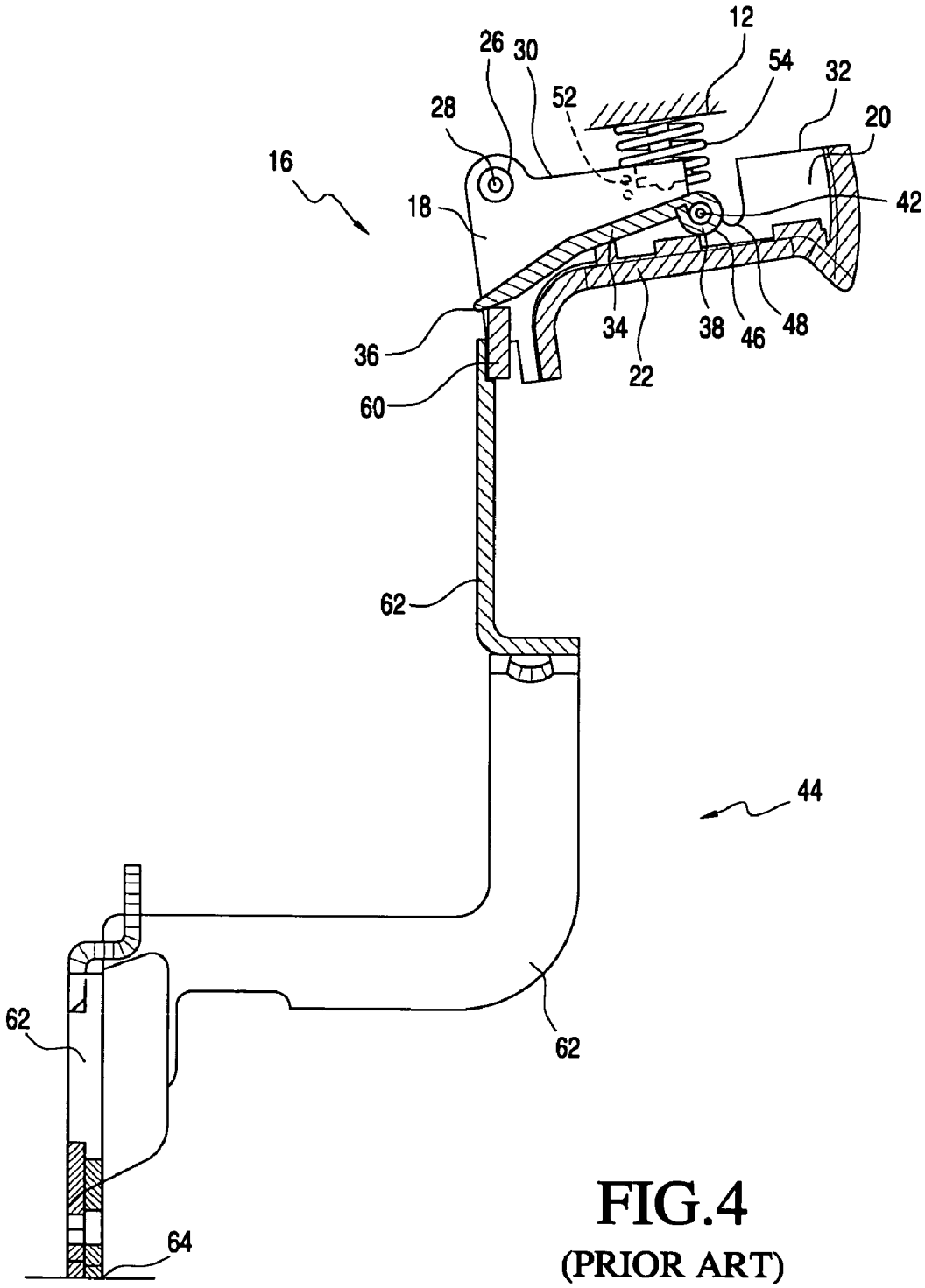
FIG.4 (PRIOR ART)
FIG. 4 is a cross-sectional view of the conventional, PRIOR ART trigger control mechanism for the fastener-driving tool, as disclosed within FIG. 3, wherein the actuation lever is positioned upon the trigger assembly at its bump firing mode position, the workpiece contacting element has been depressed against the workpiece, and the finger contact portion of the trigger has been depressed or moved upwardly.
Figure 12:
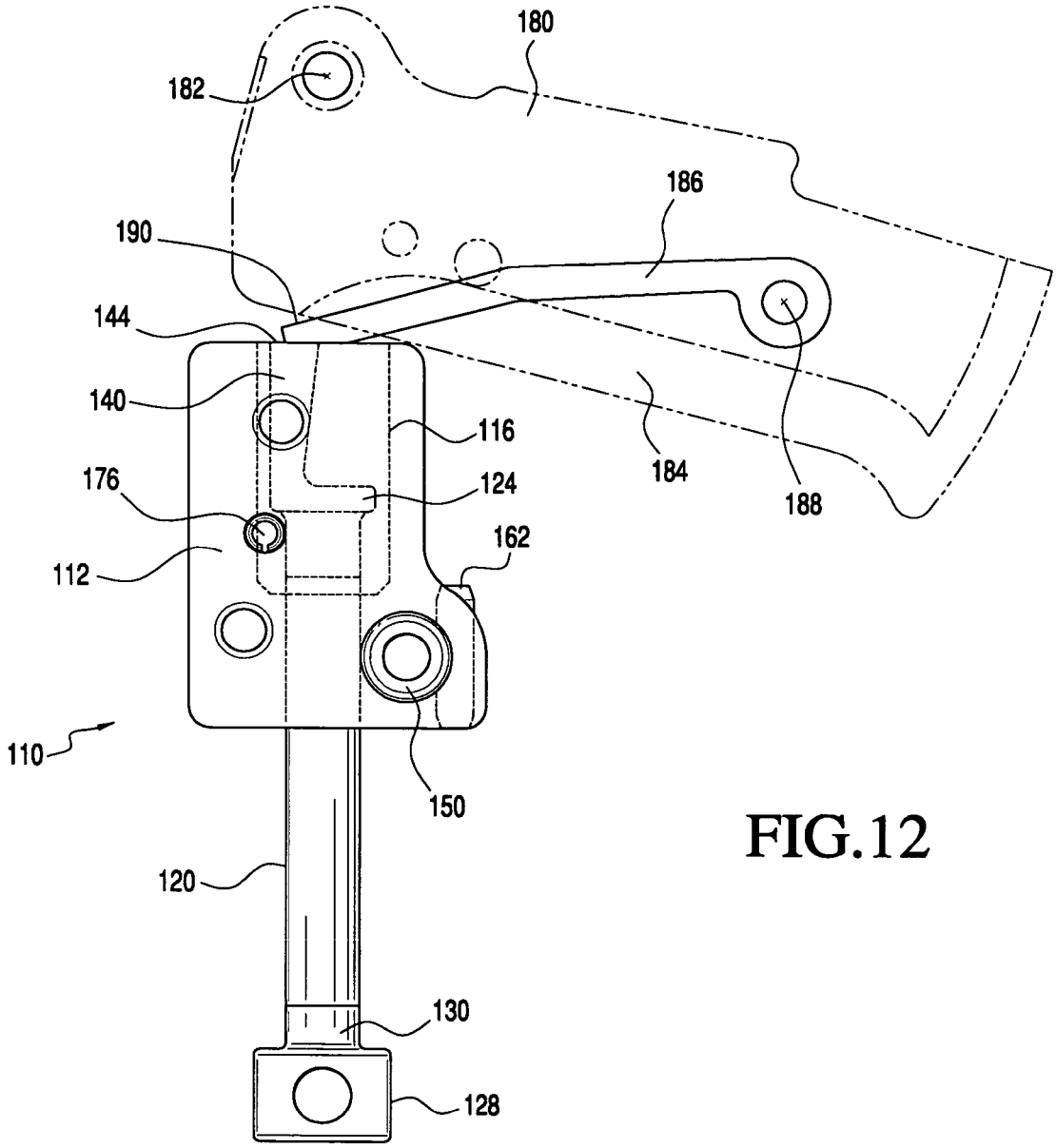
FIG. 12 is a side elevational view of the new and improved trigger control mechanism and the fastener-driving tool trigger assembly disposed at its sequential firing mode of operation state wherein the selectable mode pushrod is disposed at its lower position in view of the fact that it has not as yet been moved to its upper position by means of the workpiece contacting element.
Figure 13:
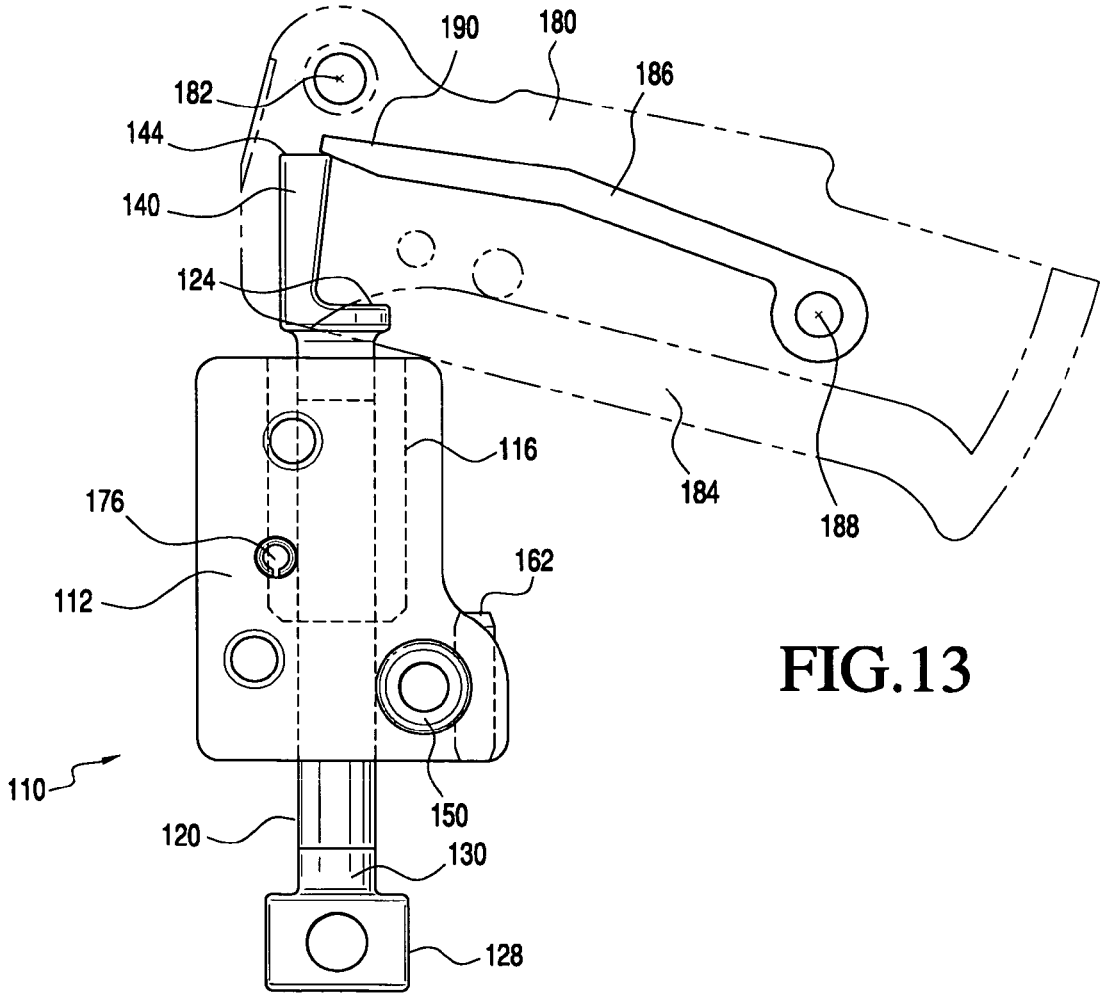
FIG. 13 is a side elevational view of the new and improved trigger control mechansism and trigger assembly, as disclosed within FIG. 12, wherein, however, the selectable mode pushrod has now been moved to its upper position as a result of the workpiece contacting element having been depressed against a workpiece.
Figure 14:
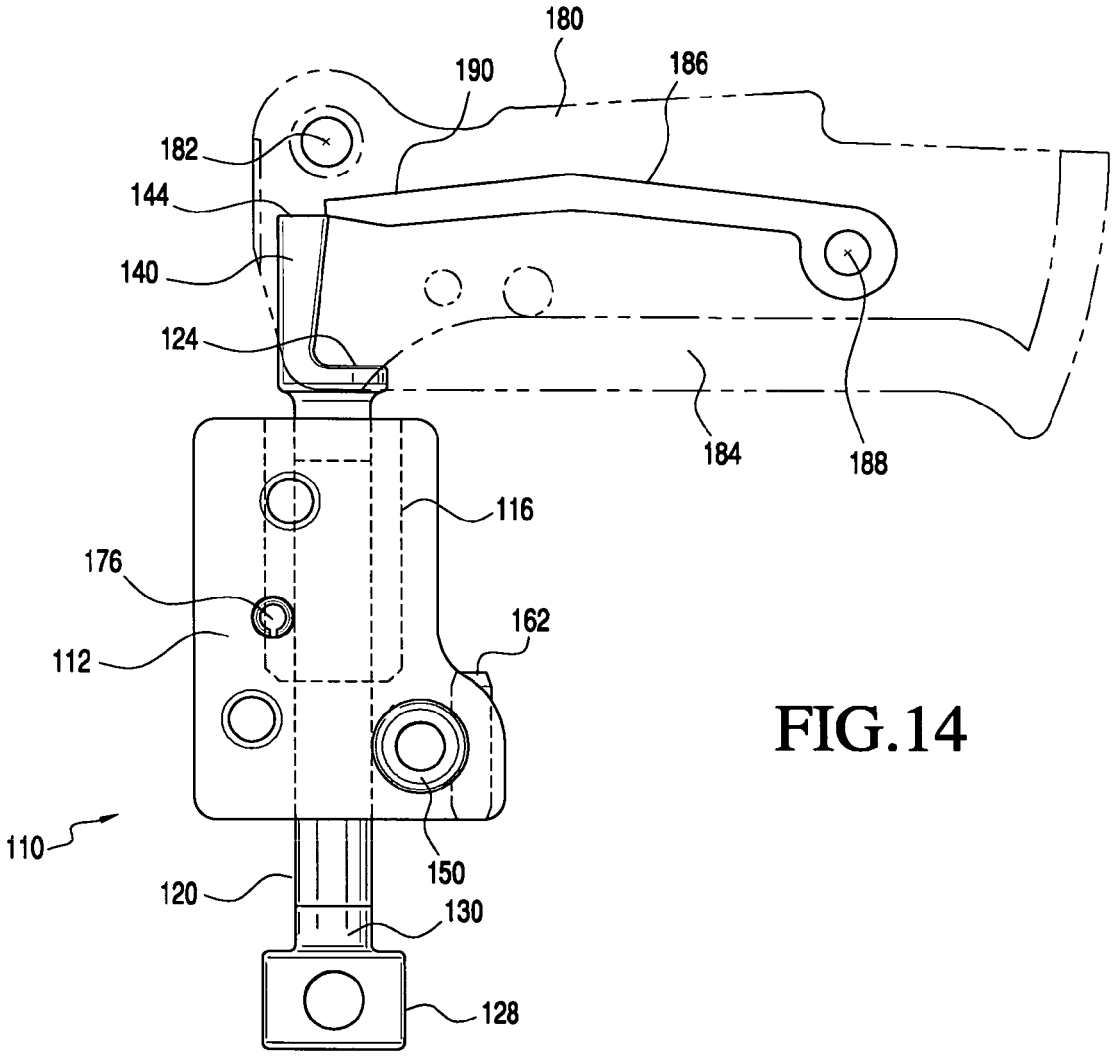
FIG. 14 is a side elevational view of the new and improved trigger control mechanism and trigger assembly, as disclosed within FIGS. 12 and 13, wherein, however, the finger contact portion of the trigger has now been depressed or moved upwardly so as to actuate the control valve in order to fire the fastener-driving tool in accordance with its sequential firing mode of operation.

Having described the various structural components comprising the new and improved trigger control mechanism 110 of the present invention, a brief description of the operation of the same within both of the sequential firing and bump-firing modes of operation will now be described. With reference being made to FIGS. 12–15, the sequential firing mode of operation will firstly be described. More particularly, as seen in FIG. 12, a trigger assembly is seen to comprise a trigger member 180 which is pivotally mounted upon the tool housing by means of a pivot pin 182, and the trigger member 180 further comprises a finger contact portion 184 which is integrally formed therewith. An actuation lever 186 is pivotally mounted internally within the trigger member 180 by means of a pivot pin 188, and a distal end portion 190 of the actuation lever 186 is adapted to be disposed in contact with the upstanding distal end portion 144 of the vertically oriented selectable mode pushrod 120 when the vertically oriented selectable mode pushrod 120 is disposed at its lowermost position, corresponding to the non-depressed position or state of the workpiece contacting element with respect to the workpiece, at the commencement of the fastener-driving tool sequential firing mode of operation. Subsequently, when the workpiece contacting element is depressed into engagement with a workpiece, the vertically oriented selectable mode pushrod 120 will be moved upwardly whereby the upstanding distal end portion 144 of the vertically oriented selectable mode pushrod 120 will correspondingly cause the actuation lever 186 to pivotally move around the pivotal end portion 188 thereof whereby the distal end portion 190 of the actuation lever 186 is now disposed at an elevated position, as illustrated within FIG. 13, so as to be disposed adjacent to the tool control valve, not illustrated but similar to the tool control valve 52 as disclosed, for example, within FIG. 1. At this point in time, it is also noted that the trigger member 180 has not as yet been depressed or moved upwardly, however, when the trigger member 180 is in fact depressed or moved upwardly as a result of the operator depressing or moving the finger contact portion 184 of the trigger member 180 upwardly, the entire trigger member 180 will be pivotally moved around the pivot pin 182 thereof, as illustrated within FIG. 14, so as to force the actuation lever 186 into contact with the tool control valve, not illustrated, whereby the fastener-driving tool will be actuated and fired. Lastly, after the fastener-driving tool has been fired, and it is desired to drive another fastener into another workpiece, or to drive another fastener into the same workpiece but at a different location upon the workpiece, the fastener-driving tool is removed from the original location of the workpiece at which the first fastener was installed, and accordingly, the vertically oriented selectable mode pushrod 120 will move downwardly as a result of the workpiece contacting element no longer being disposed in its depressed state with respect to the workpiece.

Figure 15:
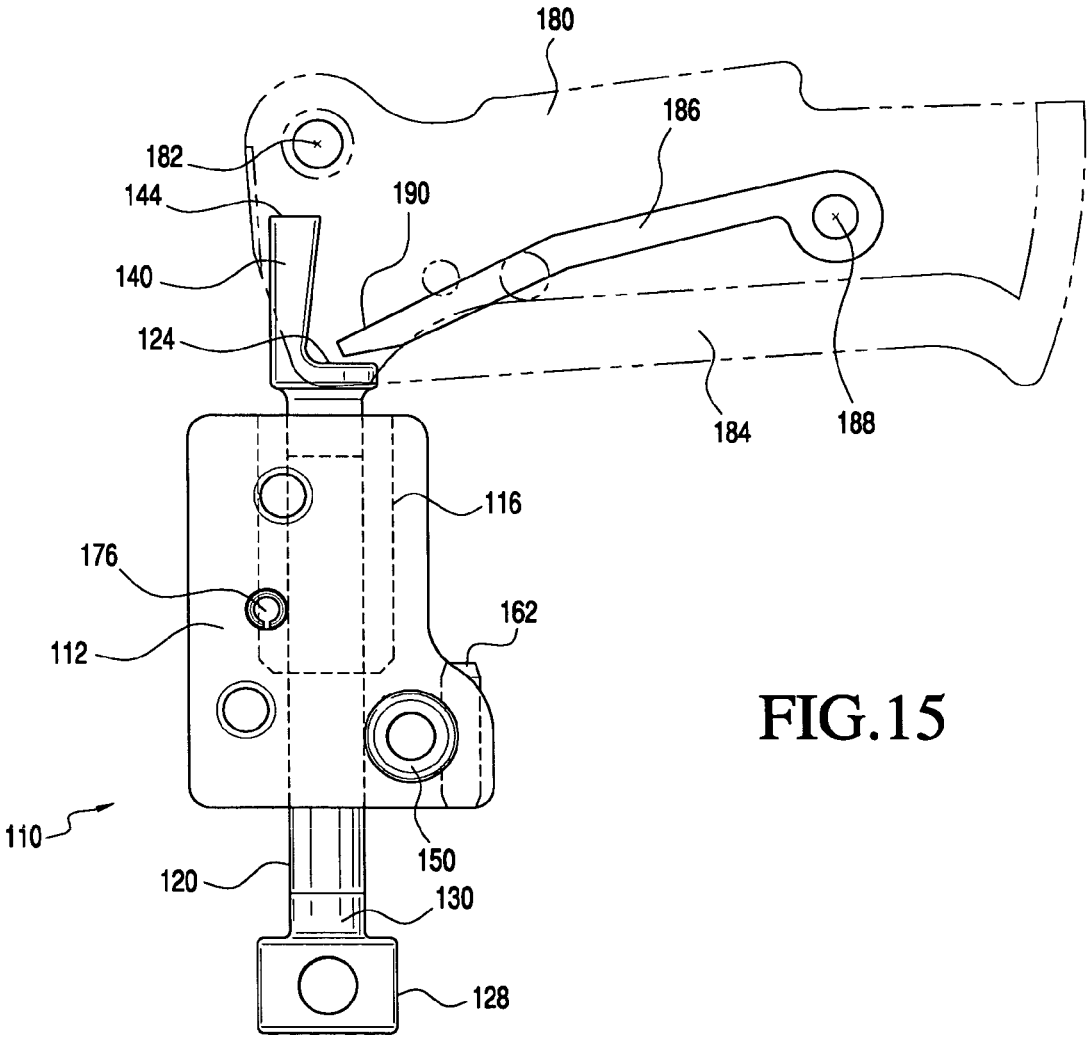
FIG. 15 is a side elevational view of the new and improved trigger control mechanism and trigger assembly, as disclosed within FIGS. 12 and 13, wherein, however, the free distal end portion of the actuation lever has been disengaged from the upstanding end portion of the selectable mode pushrod, just as the selectable mode pushrod begins to return to its lower position as a result of the workpiece contacting element having been disengaged from the workpiece, whereby further firing of the fastener-driving tool, in accordance with the sequential firing mode of operation, will not be able to be achieved until the finger contact portion of the trigger is returned to its non-depressed or lowered position as illustrated within FIGS. 12 and 13.

Therefore, as can readily be appreciated from FIG. 15, if the trigger member 180 is maintained at its depressed or upward position, then as the vertically oriented selectable mode pushrod 120 begins to move downwardly, the distal end portion 190 of the actuation lever 186 will become disengaged from the upstanding distal end portion 144 of the vertically oriented selectable mode pushrod 120 in view of the fact that the distal end portion 190 of the actuation lever 186 has effectively been removed from the vertically oriented linear path of movement of the vertically oriented selectable mode pushrod 120 due to the inclination of the trigger member 180, with respect to the vertically oriented linear path of movement of the vertically oriented selectable mode pushrod 120, as a result of the pivotal movement of the trigger member 180 around the pivotal axis defined by means of the pivot pin 182. Accordingly, the actuation lever 186 will achieve the downwardly inclined disposition as illustrated within FIG. 15. It can therefore be appreciated still further that when the vertically oriented selectable mode pushrod 120 is again moved upwardly as a result of the depressed engagement of the workpiece contacting element into contact with the new workpiece, or into contact with a different location of the same workpiece, the upstanding distal end portion 144 of the vertically oriented selectable mode pushrod 120 will not in fact engage the distal end portion 190 of the actuation lever 186 whereby the fastener-driving tool will not in fact be actuated and fired.

To the contrary, the upstanding distal end portion 144 of the vertically oriented selectable mode pushrod 120 will in effect bypass the distal end portion 190 of the actuation lever 186. Therefore, in order to in fact achieve the sequential firing mode of operation of the fastener-driving tool, the trigger member 180 must be released prior to the subsequent depressed or upward movement of the workpiece contacting element, and the corresponding upward movement of the vertically oriented selectable mode pushrod 120, in order to effectively return the trigger member 180, and the actuation lever 186, to their original positions, with respect to the vertically oriented selectable mode pushrod 120, as illustrated within FIG. 12. In other words, each time the fastener-driving tool is to be fired in accordance with its sequential firing mode of operation, the trigger member 180 and the actuation lever 186 must be disposed at their non-depressed or lowered positions, and the workpiece contacting element must be depressed against the workpiece, so as to move the vertically oriented selectable mode pushrod 120 upwardly, prior to the depressed or upward movement of the finger contact portion 184 of the trigger member 180.

Figure 16:
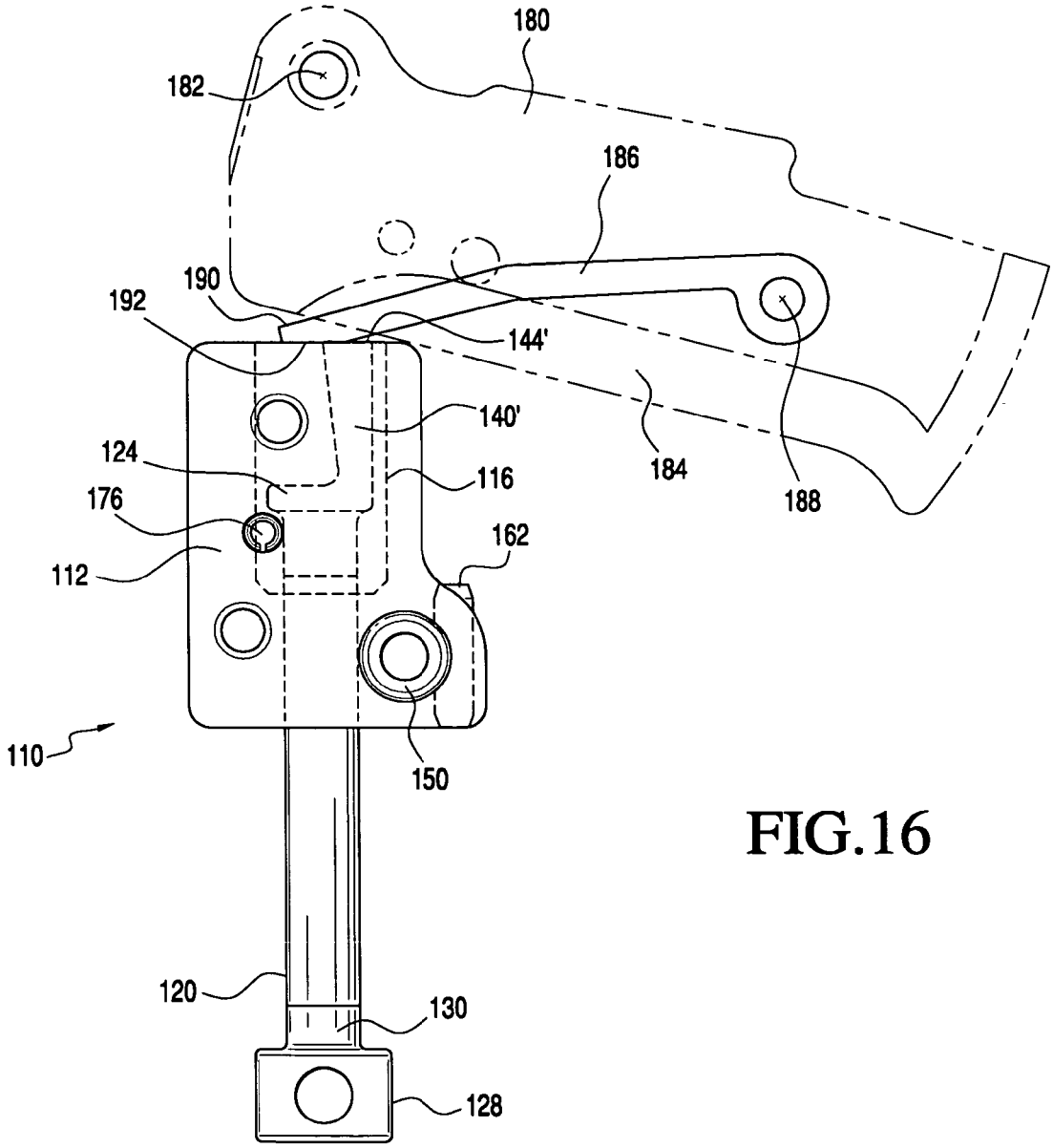
FIG. 16 is a side elevational view similar to that of FIG. 12, showing, however, the new and improved trigger control mechanism and trigger assembly disposed at its bump firing mode of operation state wherein the selectable mode pushrod is disposed at its lower position in view of the fact that it has not as yet been moved to its upper position by means of the workpiece contacting element.
Figure 17:
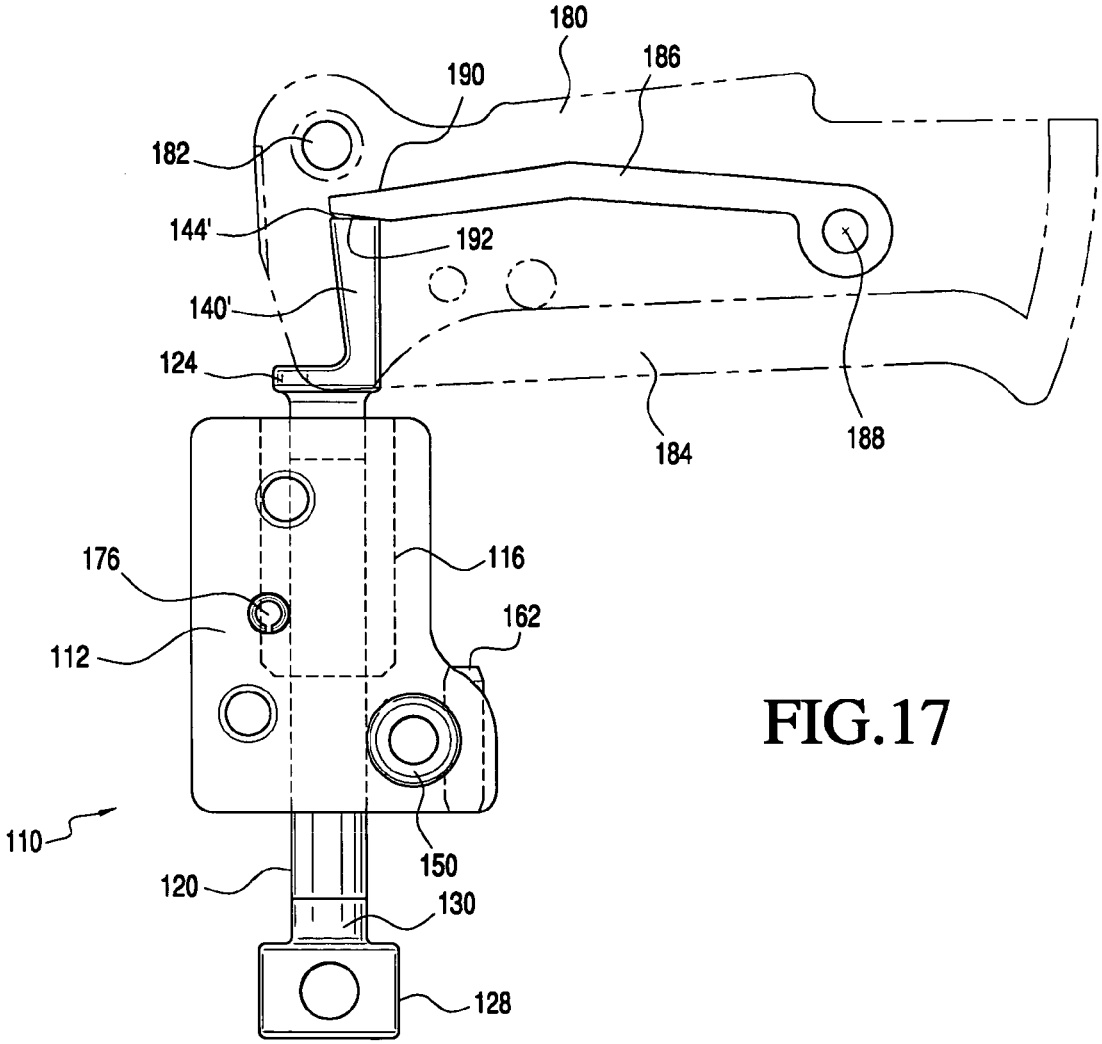
FIG. 17 is a side elevational view similar to that of FIG. 14, showing, however, the new and improved trigger control mechanism and trigger assembly disposed at its bump firing mode of operation state wherein the selectable mode pushrod is disposed at its upper position in view of having been raised or elevated by means of the workpiece contacting element, and the finger contact portion of the trigger has now been depressed or moved upwardly so as to in fact actuate the control valve in order to fire the fastener-driving tool in accordance with its bump firing mode of operation.
Figure 18:
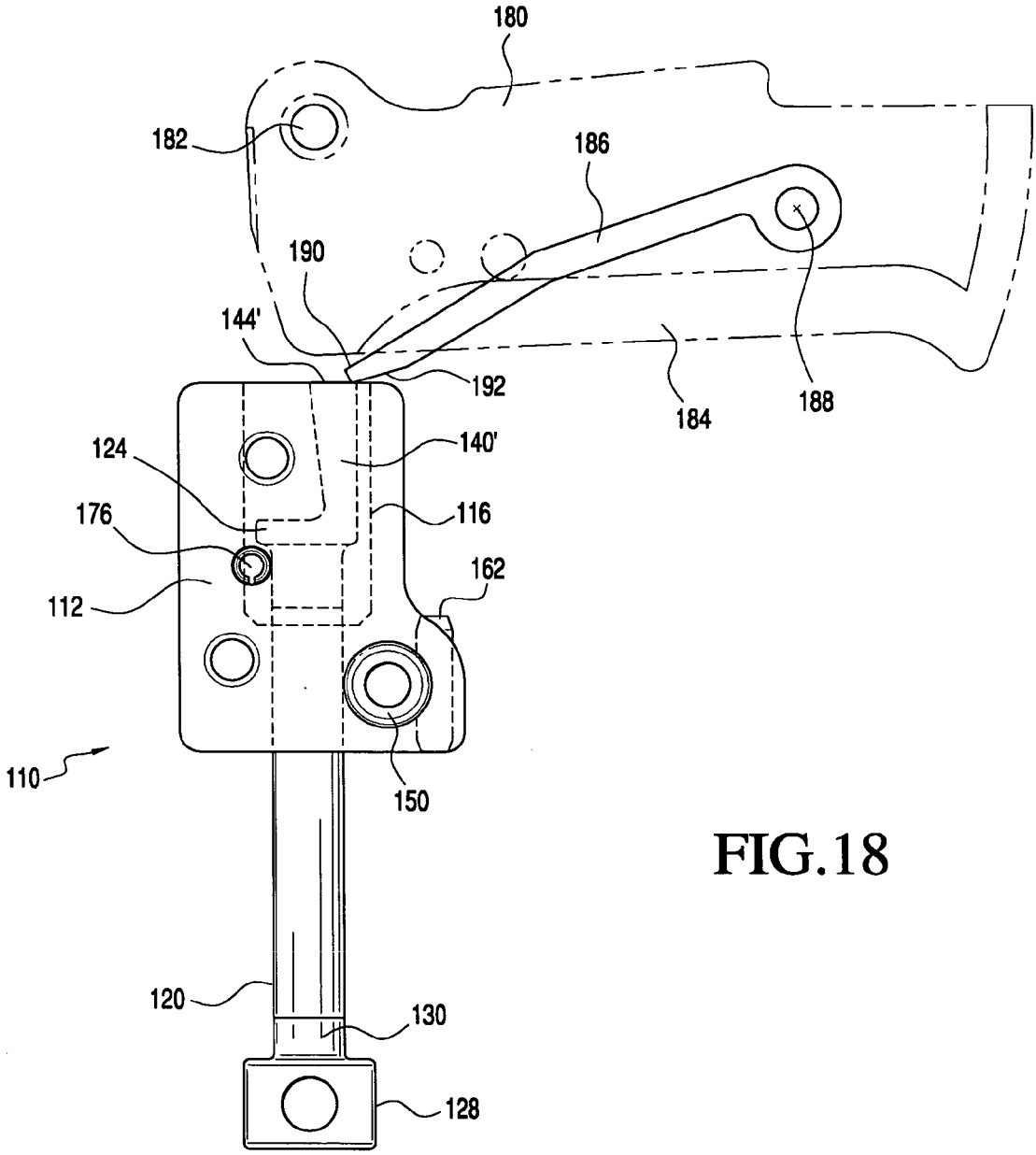
FIG. 18 is a side elevational view similar to that of FIG. 15, showing, however, the new and improved trigger control mechanism and trigger assembly disposed at its bump-firing mode of operation wherein the selectable mode pushrod is again disposed at its lower position as a result of the workpiece contacting element having been disengaged from the workpiece, however, the free distal end portion of the actuation lever remains engaged with the upstanding end portion of the selectable mode pushrod, in view of the fact that the selectable mode pushrod has been rotated to its bump firing position, whereby repeated bump firing of the fastener driving tool may in fact be achieved despite the fact that the finger contact portion of the trigger remains at its depressed or upper position.

Conversely, with reference lastly being made to FIGS. 16–18, when the vertically oriented selectable mode pushrod 120 is rotated around its axis 118 so as to be disposed at its second angular position located 180° apart from its first position illustrated within FIGS. 12–15, the upstanding projection will be disposed at its illustrated position 140', and the upstanding distal end portion 144' of the upstanding projection 140' will be disposed beneath an under-surface portion 192 of the actuation lever 186 which is located inwardly of the distal end portion 190 of the actuation lever 186 and closer to the pivotal end portion 188 of the actuation lever 186. In this manner, not only will the upstanding distal end portion 144' of the vertically oriented selectable mode pushrod 120 be able to be engaged with the undersurface portion 192 of the actuation lever 186 of the trigger assembly when a firing cycle is to be initiated, as illustrated within FIG. 16, and when the vertically oriented selectable mode pushrod 120 is moved upwardly, as illustrated within FIG. 17, as a result of the depressed engagement of the workpiece contacting element with the workpiece, but in addition, and most importantly, the locus of the vertically oriented linear path of movement of the vertically oriented selectable mode pushrod 120 will have effectively been moved inwardly a predetermined amount toward the proximal or pivotal end portion 188 of the actuation lever 186. Accordingly, unlike the disposition of the distal end portion 190 of the actuation lever 186 of the trigger assembly with respect to the vertically oriented linear path of movement of the upstanding distal end portion 144 of the vertically oriented selectable mode pushrod 120, when the vertically oriented selectable mode pushrod 120 was disposed at its first position for enabling the sequential firing of the fastener-driving tool, the distal end portion 190 of the actuation lever 186 of the trigger assembly will effectively remain disposed along the vertically oriented linear path of movement of the upstanding distal end portion 144' of the vertically oriented selectable mode pushrod 120 even when the finger contact portion 184 of the trigger 180 has been depressed or moved upwardly while the vertically oriented selectable mode pushrod 120 has been moved downwardly, as illustrated within FIG. 18, as a result of the disengagement of the workpiece contacting element from the workpiece.

In this manner, the upstanding distal end portion 144' of the vertically oriented selectable mode pushrod 120 is able to be re-engaged with the distal end portion 190 of the actuation lever 186 of the trigger assembly even when a firing cycle has been completed and the finger contact portion 184 of the trigger 180 is maintained at its depressed or upward position. In other words, additional firing cycles are able to be completed in accordance with the bump firing mode of operation of the fastener-driving tool because the distal end portion 190 of the actuation lever 186 is never, in effect, removed from the vertically oriented linear path of movement of the upstanding distal end portion 144' of the vertically oriented selectable mode pushrod 120. Therefore, regardless of whether the finger contact portion 184 and the trigger 180 are disposed at their non-depressed or lower position, or at their depressed or upper position, and regardless of whether the finger contact portion 184 and the trigger 180 are depressed or moved upwardly prior to the depressed contact engagement of the workpiece contacting element against the workpiece, and the consequent upward movement of the vertically oriented selectable mode pushrod 120, the upstanding distal end portion 144' of the vertically oriented selectable mode pushrod 120 can always engage the distal end portion 190 of the actuation lever 186 so as to repeatedly achieve the bump-firing mode of operation for the fastener-driving tool.

Thus, it may be seen that there has been provided a new and improved fastener-driving tool having a trigger control mechanism wherein, in lieu of altering the disposition of the actuation lever of the trigger assembly in order to permit the fastener-driving tool to be alternatively operated in accordance with bump firing or sequential firing modes of operation, a vertically oriented selectable mode pushrod is angularly rotated to either one of two predetermined states or positions so as to effectively alter the locus of the vertically oriented linear path of movement of an upstanding distal end portion of the vertically oriented selectable mode pushrod whereby the upstanding distal end portion of the vertically oriented selectable mode pushrod can appropriately engage the actuation lever so as to selectively achieve the sequential firing and bump firing modes of operation of the fastener-driving tool.

Obviously, many variations and modifications of the present invention are possible in light of the above teachings. For example, while the vertically oriented selectable mode pushrod 120 has been disclosed at having two diametriccally opposite operative positions for respectively achieving the sequential firing and bump firing modes of operation, other configurations of the vertically oriented selectable mode pushrod 120 are possible. For example, three flat surfaces equiangularly spaced apart 120°, in lieu of the two flat surfaces 132,132 diametrically spaced apart 180°, may be provided wherein when the vertically oriented selectable mode pushrod 120 is disposed at a first one of its positions at which a first one of the flat surfaces is engaged with the pushrod lock pin 150, the sequential firing mode of operation is enabled, whereas when the vertically oriented selectable mode pushrod 120 is disposed at a second one of its positions at which a second one of the flat surfaces is engaged with the pushrod lock pin 150, the bump firing mode of operation is enabled, and when the vertically oriented selectable mode pushrod 120 is disposed at a third one of its positions at which a third one of the flat surfaces is engaged with the pushrod lock pin 150, the fastener-driving tool is disabled. It is therefore to be understood that within the scope of the appended claims, the present invention may be practiced otherwise than as specifically described herein.

What is claimed is:

1. A trigger control mechanism for use in connection with a fastener-driving tool so as to enable the fastener-driving tool to alternatively operate in accordance with sequential and bump-firing modes of operation, comprising:

rod means, having a longitudinal axis, a first end portion adapted to be operatively engaged with an actuation lever of a trigger member of the fastener-driving tool, and a second end portion adapted to be operatively engaged with a workpiece contacting element such that said rod means is movable toward and away from the actuation lever, in response to the respective depression of the workpiece contacting element against a workpiece, and the release of the workpiece contacting element from the workpiece, whereby the actuation lever can actuate a control valve of the fastener-driving tool when said rod means is moved toward and engages the actuation lever; and said rod means being rotatably movable about said longitudinal axis between a first position at which said first end portion of said rod means will engage the actuation lever of the fastener-driving tool so as to permit the actuation lever of the fastener-driving tool to actuate the control valve of the fastener-driving tool only when the trigger member is actuated to an operative position subsequent to the depression of the workpiece contacting element against a workpiece whereby a sequential firing mode of operation of the fastener-driving tool can be achieved, and a second position at which said first end portion of said rod means will engage the actuation lever of the fastener-driving tool so as to permit the actuation lever of the fastener-driving tool to always actuate the control valve of the fastener-driving tool regardless of when the trigger member is actuated to an operative position with respect to the depression of the workpiece contacting element against the workpiece whereby a bump-firing mode of operation of the fastener-driving tool can be achieved.

2. The trigger control mechanism as set forth in claim 1, wherein:

said first and second positions, between which said rod means is rotatably moved, are located 180° apart from each other.

3. The trigger control mechanism as set forth in claim 1, further comprising:

a lock pin movably mounted between a first position at which said rod means is locked and unable to be moved between said first and second positions so as to permit the fastener-driving tool to be operated in accordance with one of the sequential and bump firing modes of operation, and a second position at which said rod means is permitted to be moved between said first and second positions so as to selectively enable the fastener-driving tool to be operated in accordance with one of the sequential and bump firing modes of operation.

4. The trigger control mechanism as set forth in claim 1, wherein:

said first end portion of said rod means comprises an axially extending projection having a substantially semi-cylindrical cross-sectional configuration such that when said rod means is disposed at said first position, said semi-cylindrically configured axially extending projection will be disposed upon a first side of said longitudinal axis so as to engage a distal end portion of the actuation lever of the fastener-driving tool, whereas when said rod means is rotated around said longitudinal axis so as to be disposed at said second position, said semi-cylindrically configured axially extending projection will be disposed upon an opposite side of said longitudinal axis so as to engage a portion of the actuation lever of the fastener-driving tool which is disposed away from the distal end portion of the actuation lever of the fastener-driving tool.

5. The trigger control mechanism as set forth in claim 1, further comprising:

a tool-enabling pin operatively associated with said rod means for permitting said rod means to engage the actuation lever of the fastener-driving tool so as to enable the firing of the fastener-driving tool when said rod means has been moved to, and is disposed at, one of said first and second positions, and for preventing said rod means from engaging the actuation lever of the fastener-driving tool so as to prevent the firing of the fastener-driving tool when said rod means has not been moved to, and is not disposed at, one of said first and second positions.

6. In combination, a trigger control mechanism and a trigger assembly for use in connection with a fastener-driving tool so as to enable the fastener-driving tool to alternatively operate in accordance with sequential and bump-firing modes of operation, comprising:

a trigger member;

an actuation lever movably mounted upon said trigger member for actuating a control valve of the fastener-driving tool;

rod means, having a longitudinal axis, a first end portion adapted to be operatively engaged with said actuation lever of said trigger member of the fastener-driving tool, and a second end portion adapted to be operatively engaged with a workpiece contacting element such that said rod means is movable toward and away from said actuation lever, in response to the respective depression of the workpiece contacting element against a workpiece, and the release of the workpiece contacting element from the workpiece, whereby said actuation lever can actuate a control valve of the fastener-driving tool when said rod means is moved toward and engages said actuation lever; and said rod means being rotatably movable about said longitudinal axis between a first position at which said first end portion of said rod means will engage said actuation lever of the fastener-driving tool so as to permit said actuation lever of the fastener-driving tool to actuate the control valve of the fastener-driving tool only when said trigger member is actuated to an operative position subsequent to the depression of the workpiece contacting element against a workpiece whereby a sequential firing mode of operation of the fastener-driving tool can be achieved, and a second position at which said first end portion of said rod means will engage said actuation lever of the fastener-driving tool so as to permit said actuation lever of the fastener-driving tool to always actuate the control valve of the fastener-driving tool regardless of when said trigger member is actuated to an operative position with respect to the depression of the work-piece contacting element against the workpiece whereby a bump-firing mode of operation of the fastener-driving tool can be achieved.

7. The combination as set forth in claim 6, wherein:

said first and second positions, between which said rod means is rotatably moved, are located 180° apart from each other.

8. The combination as set forth in claim 6, further comprising:

a lock pin movably mounted between a first position at which said rod means is locked and unable to be moved between said first and second positions so as to permit the fastener-driving tool to be operated in accordance with one of the sequential and bump firing modes of operation, and a second position at which said rod means is permitted to be moved between said first and second positions so as to selectively enable the fastener-driving tool to be operated in accordance with one of the sequential and bump firing modes of operation.

9. The combination as set forth in claim 6, wherein:

said first end portion of said rod means comprises an axially extending projection having a substantially semi-cylindrical cross-sectional configuration such that when said rod means is disposed at said first position, said semi-cylindrically configured axially extending projection will be disposed upon a first side of said longitudinal axis so as to engage a distal end portion of said actuation lever of the fastener-driving tool, whereas when said rod means is rotated around said longitudinal axis so as to be disposed at said second position, said semi-cylindrically configured axially extending projection will be disposed upon an opposite side of said longitudinal axis so as to engage a portion of said actuation lever of the fastener-driving tool which is disposed away from said distal end portion of said actuation lever of the fastener-driving tool.

10. The combination as set forth in claim 6, further comprising:

a tool-enabling pin operatively associated with said rod means for permitting said rod means to engage said actuation lever of the fastener-driving tool so as to enable the firing of the fastener-driving tool when said rod means has been moved to, and is disposed at, one of said first and second positions, and for preventing said rod means from engaging said actuation lever of the fastener-driving tool so as to prevent the firing of the fastener-driving tool when said rod means has not been moved to, and is not disposed at, one of said first and second positions.

11. A fastener-driving tool having a trigger control mechanism and a trigger assembly for enabling the fastener-driving tool to alternatively operate in accordance with sequential and bump-firing modes of operation, comprising:

a workpiece contacting element;

a control valve;

a trigger member;

an actuation lever movably mounted upon said trigger member for actuating said control valve of said fastener-driving tool;

rod means, having a longitudinal axis, a first end portion adapted to be operatively engaged with said actuation lever of said trigger member of said fastener-driving tool, and a second end portion adapted to be operatively engaged with said workpiece contacting element such that said rod means is movable toward and away from said actuation lever, in response to the respective depression of said workpiece contacting element against a workpiece, and the release of said workpiece contacting element from the workpiece, whereby said actuation lever can actuate said control valve of said fastener-driving tool when said rod means is moved toward and engages said actuation lever; and said rod means being rotatably movable about said longitudinal axis between a first position at which said first end portion of said rod means will engage said actuation lever of said fastener-driving tool so as to permit said actuation lever of said fastener-driving tool to actuate said control valve of said fastener-driving tool only when said trigger member is actuated to an operative position subsequent to the depression of said workpiece contacting element against a workpiece whereby a sequential firing mode of operation of said fastener-driving tool can be achieved, and a second position at which said first end portion of said rod means will engage said actuation lever of said fastener-driving tool so as to permit said actuation lever of said fastener-driving tool to always actuate said control valve of said fastener-driving tool regardless of when said trigger member is actuated to an operative position with respect to the depression of said workpiece contacting element against the workpiece whereby a bump-firing mode of operation of said fastener-driving tool can be achieved.

12. The fastener-driving tool as set forth in claim 11, wherein:

said first and second positions, between which said rod means is rotatably moved, are located 180° apart from each other.

13. The fastener-driving tool as set forth in claim 11, further comprising:

a lock pin movably mounted between a first position at which said rod means is locked and unable to be moved between said first and second positions so as to permit said fastener-driving tool to be operated in accordance with one of the sequential and bump firing modes of operation, and a second position at which said rod means is permitted to be moved between said first and second positions so as to selectively enable said fastener-driving tool to be operated in accordance with one of the sequential and bump firing modes of operation.

14. The fastener-driving tool as set forth in claim 11, wherein:

said first end portion of said rod means comprises an axially extending projection having a substantially semi-cylindrical cross-sectional configuration such that when said rod means is disposed at said first position, said semi-cylindrically configured axially extending projection will be disposed upon a first side of said longitudinal axis so as to engage a distal end portion of said actuation lever of said fastener-driving tool, whereas when said rod means is rotated around said longitudinal axis so as to be disposed at said second position, said semi-cylindrically configured axially extending projection will be disposed upon an opposite side of said longitudinal axis so as to engage a portion of said actuation lever of said fastener-driving tool which is disposed away from said distal end portion of said actuation lever of said fastener-driving tool.

15. The fastener-driving tool as set forth in claim 11, further comprising:

a tool-enabling pin operatively associated with said rod means for permitting said rod means to engage said actuation lever of said fastener-driving tool so as to enable the firing of said fastener-driving tool when said rod means has been moved to, and is disposed at, one of said first and second positions, and for preventing said rod means from engaging said actuation lever of said fastener-driving tool so as to prevent the firing of said fastener-driving tool when said rod means has not been moved to, and is not disposed at, one of said first and second positions.

* * * * *